US007176869B2

(12) United States Patent
Kumada et al.

(10) Patent No.: US 7,176,869 B2
(45) Date of Patent: Feb. 13, 2007

(54) DRIVE CIRCUIT FOR USE IN LIQUID CRYSTAL DISPLAY, LIQUID CRYSTAL DISPLAY INCORPORATING THE SAME, AND ELECTRONICS INCORPORATING THE LIQUID CRYSTAL DISPLAY

(75) Inventors: Kouji Kumada, Tenri (JP); Toshihiro Yanagi, Nara (JP); Takashige Ohta, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 906 days.

(21) Appl. No.: 09/898,185

(22) Filed: Jul. 3, 2001

(65) Prior Publication Data

US 2002/0008686 A1 Jan. 24, 2002

(30) Foreign Application Priority Data

Jul. 24, 2000 (JP) ..... 2000-222880
May 23, 2001 (JP) ..... 2001-154258

(51) Int. Cl.
*G09G 3/36* (2006.01)

(52) U.S. Cl. ..... 345/94; 345/204

(58) Field of Classification Search ..... 345/87, 345/92, 94, 95, 96, 101, 102, 202, 204, 205, 345/88, 89, 90, 91, 93, 97, 98; 349/72
See application file for complete search history.

(56) References Cited

U.S. PATENT DOCUMENTS 5,402,142 A 3/1995 Okada et al.
5,428,370 A * 6/1995 Knapp et al. ..... 345/205
5,579,027 A * 11/1996 Sakurai et al. ..... 345/100

(Continued)

FOREIGN PATENT DOCUMENTS

JP 61-249094 11/1986

(Continued)

OTHER PUBLICATIONS

Japanese Office Action mailed Aug. 2, 2005 (with English Translation of Notice of Reasons for Refusal).

*Primary Examiner*—Richard Hjerpe
*Assistant Examiner*—Jean Lesperance
(74) *Attorney, Agent, or Firm*—David G. Conlin; John J. Penny, Jr.; Edwards Angell Palmer & Dodge LLP

(57) ABSTRACT

A drive circuit for use in a liquid crystal display supplies source signals from a source driver to pixel electrodes through switching by means of TFTs according to scan signals from a gate driver, includes a reference voltage generator circuit for adjusting potential differences between the pixel electrodes and a common electrode so as to compensate for the effects of variations in drain voltages caused by parasitic capacity in the TFTs and compensate for irregularities in DC voltage caused by asymmetry in properties between an active matrix substrate and an opposite substrate sandwiching a liquid crystal layer. The reference voltage generator circuit is composed of a reference voltage generator circuit for shifting the voltage levels of the source signals supplied by the source driver equally for all the pixel electrodes. Thus, the drive circuit for use in a liquid crystal display is applicable to portable electronics operative without necessarily performing periodical D/A conversions and includes the reference voltage generator circuit running on a reduced power supply.

(Continued)

27 Claims, 10 Drawing Sheets

U.S. PATENT DOCUMENTS

| | | | | |
|---|---|---|---|---|
| 5,751,267 | A * | 5/1998 | Sato et al. | 345/96 |
| 5,798,740 | A * | 8/1998 | Bitzakidis et al. | 345/92 |
| 6,118,421 | A * | 9/2000 | Kawaguchi et al. | 345/89 |
| 6,307,681 | B1 * | 10/2001 | Aoki et al. | 359/645 |
| 6,466,191 | B1 * | 10/2002 | Choi et al. | 345/94 |

FOREIGN PATENT DOCUMENTS

| | | |
|---|---|---|
| JP | 1-120196 | 8/1989 |
| JP | 04-293014 | 10/1992 |
| JP | 05-265410 | 10/1993 |
| JP | 07-294874 | 11/1995 |
| JP | 7-120146 | 12/1995 |
| JP | 07-333576 | 12/1995 |
| JP | 08-166578 | 6/1996 |
| JP | 11-015442 | 1/1999 |
| JP | 11-065527 | 3/1999 |
| JP | 11-175027 | 7/1999 |
| JP | 11-202299 | 7/1999 |
| JP | 11-271716 | 10/1999 |
| JP | 11-281949 | 10/1999 |
| JP | 2000-002868 | 1/2000 |

* cited by examiner

DRIVE CIRCUIT FOR USE IN LIQUID CRYSTAL DISPLAY, LIQUID CRYSTAL DISPLAY INCORPORATING THE SAME, AND ELECTRONICS INCORPORATING THE LIQUID CRYSTAL DISPLAY

FIELD OF THE INVENTION

The present invention relates to a drive circuit for use in an active-matrix-drive liquid crystal display; a reflective, opaque, reflective/transparent, transparent, or other type of liquid crystal display incorporating the same; and electronics incorporating such a liquid crystal display including portable electronics such as a mobile telephone, personal data assistant (PDA), notebook personal computer, portable television set, and portable game machine. More specifically, the present invention relates to a circuit for adjusting the potential difference between a pixel electrode and a common electrode, for the purposes, among others, of compensating for the effects of variations in the drain voltage caused by parasitic capacity in a thin film transistor and adjusting irregularities in DC voltage caused by asymmetry of an active matrix substrate and an opposite substrate.

BACKGROUND OF THE INVENTION

Typically, in an active-matrix-drive liquid crystal display (LCD) incorporating thin film transistors (TFTs), the DC level of a common electrode signal is adjusted for each panel.

The adjustment is done to carry out such compensation that maintains the potential difference between a pixel electrode and a common electrode at a suitable value, because, among other reasons, a drain voltage varies due to the effects of the parasitic capacity of a TFT when the TFT is switched from ON to OFF as disclosed in Japanese Publication for Examined Patent Application No. 7-120146/1995 (Tokukohei 7-120146; published on Dec. 20, 1995).

In other words, variations in the drain voltage caused by the effects of a parasitic capacity of the TFT are erratic and contain irregularity that occur with each panel in manufacture. Therefore, an arrangement is made to adjust the DC level (DC voltage) for each panel.

Specifically, for example, a common electrode signal generator circuit 50 as shown in FIG. 8 is used as a circuit to adjust the DC level, i.e., the voltage level, of the common electrode signal. In the figure, a common electrode signal $V_{COM}$ is produced by means of a C-MOS (Complementary Metal Oxide Semiconductor) switch 51 switching between a positive power source $V_{DD}$ and a ground potential GND according to a control signal $V_{IN}$.

More specifically, in the common electrode signal generator circuit 50, the common electrode signal $V_{COM}$ is produced by combining the output from the positive power source $V_{DD}$ and the output from the C-MOS switch 51 and a capacitor 58 in a clamp circuit 57 composed of two transistors 52, 53, two resistors 54, 55, and a variable resistor 56. The DC level of the common electrode signal $V_{COM}$ is adjusted by varying the variable resistor 56 in the clamp circuit 57. In this manner, the DC level as the potential difference between the common electrode signal $V_{COM}$ and a pixel electrode (not shown) is adjusted to an optimum value in light of variations in the drain voltage caused by the effects of a parasitic capacity of the TFT.

Meanwhile, as shown in FIGS. 9 and 10, a source driver 61 for supplying source signal voltages to source signal lines of the TFT-LCD panel is typically of a 6 to 8 bit R-DAC type and carries out digital-to-analog conversion (D/A conversion) based on reference voltages V1 to V4 fed from an external reference voltage generator circuit 62 to produce source signal voltages. Here, the plurality of reference voltages V1 to V4 are used, because the dielectric constant of liquid crystal varies with applied voltages.

Also, the effects of a parasitic capacity of TFTs 63 on a drain voltage change with the voltage applied to liquid crystal. Therefore, the DC level needs be switched for a white display and a black display, as disclosed in the U.S. Pat. No. 5,402,142 (issued: Mar. 28, 1995) among others. Accordingly, as shown in FIG. 10, by dividing the voltage difference between the ground potential GND and an high reference voltage $V_{HIGH}$ fixed, for example, at about 4 V with resistors R21, R22, R23, R24, R25, switches SW1, SW3, SW5, SW7 are turned on according to a signal $\phi$ to supply reference voltages V1 to V4 to the source driver 61. Meanwhile, by dividing the high reference voltage $V_{HIGH}$ with resistors R11, R12, R13, R14, R15, switches SW2, SW4, SW6, SW8 are turned on according to a signal $\overline{\phi}$ to supply to the source driver 61 reference voltages V'1 to V'4 (not shown) that are different from the reference voltages V1 to V4.

In other words, according to the foregoing technique, D/A conversion is carried out based on the reference voltages V1 to V4 or reference voltages V'1 to V'4, which is equivalent to simultaneous execution of a non-linear conversion that matches with characteristics of liquid crystal and a gamma correction that compensates for differences between applied voltage-transmittivity characteristics of liquid crystal and the optic nature of the human eye.

However, in drive circuits in conventional liquid crystal displays, like the one above, the clamp circuit 57 serves as a common electrode signal generator circuit 50 that adjusts the common electrode signal $V_{COM}$; therefore, the resistor 55 and the variable resistor 56 in the clamp circuit 57 always receive the positive power source $V_{DD}$. The clamp circuit 57 hence is power consuming and does not make a suitable application in the TFT-LCD for use in portable and other electronics where low power consumption is essential.

Besides, in the conventional common electrode signal generator circuit 50, the common electrode signal $V_{COM}$ is switched between a +5 V positive power source $V_{DD}$ and a 0 V ground potential GND according to a control signal $V_{IN}$, and an alternating signal that alternates between voltages, for example, +4 V and −1 V is produced by a D/A conversion by the resistors 54, 55, variable resistor 56, and capacitor 58 in the clamp circuit 57.

However, a problem occurs if the clamp circuit 57 and the capacitor 58 are interposed: it becomes difficult to produce a stable common electrode signal $V_{COM}$. Specifically, for example, when the C-MOS switch 51 is switched to a +5 V positive power source $V_{DD}$ by the control signal $V_{IN}$, the DC level of the common electrode signal $V_{COM}$ varies and cannot be maintained at +4 V. When the C-MOS switch 51 is switched again to an D/A-converted alternating signal, the alternating signal starts from the varying DC level and the common electrode signal $V_{COM}$ gradually returns to an alternating voltage between +4 V and −1 V.

As described above, the common electrodes cannot be maintained at a stable DC level with the conventional common electrode signal generator circuit 50 incorporating the clamp circuit 57 and capacitor 58 without periodical D/A conversions. The conventional common electrode signal generator circuit 50 therefore cannot be used for low frequency drive and suspension drive.

If the pixel electrode is made of a plurality of kinds of metal film layers, irregularities develop in DC voltage component between the drain of the thin film transistor and the one of the plurality of kinds of metal film layers that constitutes the pixel electrode electrically connected to the drain and that is located closer to a liquid crystal layer than the other metal film(s). For example, if aluminum (Al) is vapor-deposited or otherwise formed on the drain electrode, and the pixel electrode is made of a plurality of kinds of metal film layers, a plurality of kinds of metals exist between the drain electrode and an aluminum (Al) or other metal film that constitutes the pixel electrode and that is in contact with the liquid crystal; therefore, a potential difference develops between the drain electrode and the aluminum (Al).

The aforementioned conventional adjusting means is effective in adjustment of the potential difference developing in this manner between a plurality of kinds of metal film layers, but is still power consuming and has other problems too.

Variations in the DC level of the liquid crystal layer are caused also by other factors: for example, asymmetry in properties between the active matrix substrate and the opposite substrate sandwiching the liquid crystal layer. The DC component caused by the asymmetry between the active matrix substrate and the opposite substrate always acts on the liquid crystal layer.

Asymmetry between the substrates can be found, for example, in the thickness of the aligning film, the material composing the aligning film as in a case of hybrid alignment, and the material composing the electrodes positioned oppositely across the liquid crystal layer as in a case of a reflective liquid crystal display where the reflective electrodes on the active matrix substrate are made of aluminum (Al) and the transparent electrodes on the opposite substrate are made of ITO. Among these factors, the asymmetry in the material composing the electrodes positioned oppositely across the liquid crystal layer causes largest variations in the DC level.

In addition, these DC level variations caused by different electrode materials are not computable, and adjusting the potential of a common electrode is a time-consuming process, during which the DC continues to act on the liquid crystal layer. This degrades the reliability of the liquid crystal display and results in persistent residual image and other undesirable effects.

Although the aforementioned conventional adjusting circuit is capable of adjusting the DC component caused by the asymmetry between the active matrix substrate and the opposite substrate sandwiching the liquid crystal layer, it still consumes large amounts of power.

SUMMARY OF THE INVENTION

The present invention has an objective to offer a drive circuit, for use in a liquid crystal display, that is applicable to electronics operative without necessarily performing periodical D/A conversions and that includes an adjusting circuit running on a reduced power supply for adjusting the potential differences between pixel electrodes and a common electrode and to further offer a liquid crystal display incorporating the drive circuit and electronics incorporating the liquid crystal display.

To achieve the objective, a drive circuit for use in a liquid crystal display in accordance with the present invention includes: a reference voltage generator circuit for causing thin film transistors to switch according to scan signals from a gate driver so as to supply source signals from a source driver to pixel electrodes and also for adjusting potential differences between the pixel electrodes and a common electrode, wherein the reference voltage generator circuit shifts the voltage levels of the source signals supplied by the source driver equally for all the pixel electrodes.

According to the arrangement, the reference voltage generator circuit adjusts the potential difference between the pixel electrodes and the common electrode for the purposes, among others, of compensating for the effects of variations in drain voltages caused by parasitic capacity in the thin film transistors, compensating for irregularities in DC voltage component between the drains and the metal film that constitutes the multi-layered pixel electrodes and that is located closer to the liquid crystal layer than the other metal film(s), and compensating for irregularities in DC voltages caused by asymmetry in properties of the active matrix substrate and the opposite substrate sandwiching a liquid crystal layer.

The reference voltage generator circuit adjusts the voltage levels of the source signals supplied by the source driver and shifts the voltage levels of the source signals equally for all the pixel electrodes. Put differently, the reference voltage generator circuit is capable of shifting the overall DC levels while keeping the potential difference of the mean voltage of tone voltages.

As a result, the drive circuit for use in a liquid crystal display in accordance with the present invention is capable of maintaining the potential of the common electrode at a fixed value and no longer requires a conventionally indispensable clamp circuit with resistors for voltage adjustment, which eliminates possibilities of increased power consumption due to the presence of a clamp circuit. The elimination of the clamp circuit and capacitor makes it possible to use the drive circuit for low frequency drive and suspension drive.

The resultant drive circuit for use in a liquid crystal display to compensate for variations in drain voltage, irregularities in DC voltage component due to multi-layered pixel electrodes, and irregularities in DC voltages caused by asymmetry in properties of substrates sandwiching a liquid crystal layer is applicable to portable and other electronics operative without necessarily performing periodical D/A conversions and includes a reference voltage generator circuit running on a reduced power supply for adjusting the potential differences between the pixel electrodes and the common electrode.

For a fuller understanding of the nature and advantages of the invention, reference should be made to the ensuing detailed description taken in conjunction with the accompanying drawings.

DESCRIPTION OF THE EMBODIMENTS

Embodiment 1

The following will describe an embodiment in accordance with the present invention in reference to FIGS. 1 to 4. The present embodiment will be described in reference to an active-matrix-type liquid crystal display. The invention is applicable to liquid crystal displays including reflective, opaque, reflective/transparent, and transparent types and suitably applicable to portable and other electronics such as mobile telephones, personal data assistants (PDAs), notebook personal computers, portable television sets, and portable game machines.

Figure 2:
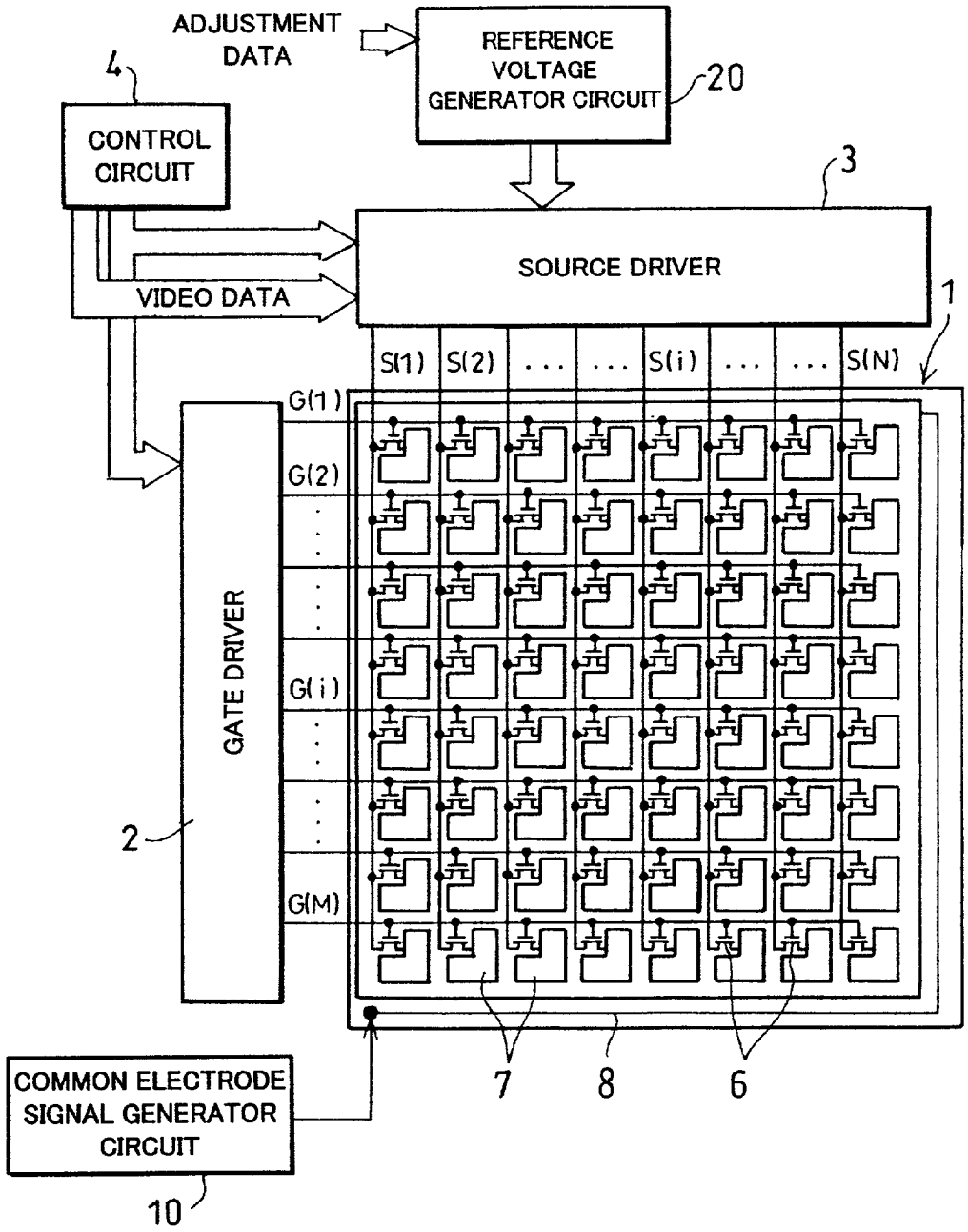
FIG. 2 is a schematic showing the overall construction of the drive circuit for use in a liquid crystal display.

As shown in FIG. 2, the active-matrix-type liquid crystal display (hereinafter, will be referred to as the LCD) of the present embodiment includes a gate driver 2 as a scan signal driver for supplying scan signals in a pixel selection period, a source driver 3 as a data signal driver for supplying data signals to a liquid crystal panel 1, and a control circuit 4 for controlling timings for the gate driver 2 and the source driver 3.

The liquid crystal panel 1 includes: source bus lines S(1), S(2), . . . S(N) for supplying data signals and gate bus lines G(1), G(2), . . . G(M) for supplying scan signals, the source and bus lines being provided to form a lattice on a glass substrate; thin film transistors (hereinafter, will be referred to as TFTs) 6 each provided at a different lattice point as a switching element; pixel electrodes 7 connected via the TFTs 6 to the source bus lines S(1), S(2), . . . S(N); and a common electrode 8 provided opposite to the pixel electrodes 7.

In this liquid crystal display, graphic data is transmitted from the control circuit 4 to the source driver 3 where the graphic data signal is converted from digital to analog and supplied to the liquid crystal panel 1 as its drive voltage. The reference voltage generator circuit (adjusting means, voltage level altering means, reference voltage generator means) 20 connected to the source driver 3 produces a voltage that serves as a reference in the D-to-A conversion of the graphic data signal.

Meanwhile, the control circuit 4 transmits graphic data to the source driver 3 as mentioned earlier, as well as transmits a scan signal to the gate driver 2. Accordingly, the gate driver 2 scans the gate bus lines G(1), G(2), . . . , and the source driver 3 supplies graphic signals to the pixel electrodes 7 via associated source bus lines S(1), S(2), . . . and TFTs 6 by controlling the turning-on and -off of the TFTs 6 in the liquid crystal panel 1.

The common electrode 8 is one continuous sheet and almost entirely covers the liquid crystal panel 1. The common electrode 8 receives a common electrode signal from a common electrode signal generator circuit 10 as common electrode signal generator means. In other words, the liquid crystal (not shown) sandwiched between the pixel electrodes 7 and the common electrode 8 changes with the potential differences between the pixel electrodes 7 and the common electrode 8 for the pixels to produce a display.

In the liquid crystal panel 1, for example, due to parasitic capacity in the TFT 6, the drain voltage varies when the TFT 6 changes from an ON state to an OFF state. The variation differs from one liquid crystal panel 1 to another, depending on irregularity that occur during manufacture, and needs be adjusted for each liquid crystal panel 1.

The variations in the DC level of the liquid crystal layer are caused by, in addition to the aforementioned parasitic capacity in the TFT 6, asymmetry in properties between the active matrix substrate and the opposite substrate sandwiching the liquid crystal layer. The DC component caused by the asymmetry between the active matrix substrate and the opposite substrate always acts on the liquid crystal layer.

Asymmetry in properties between the substrates can be found, for example, in the thickness of the aligning film, the material composing the aligning film as in a case of hybrid alignment, and the material composing the electrodes positioned oppositely across the liquid crystal layer as in a case of a reflective liquid crystal display where the reflective electrodes on the active matrix substrate are made of aluminum (Al) and the transparent electrodes on the opposite substrate are made of ITO. Among these factors, the asymmetry in the material composing the electrodes positioned oppositely across the liquid crystal layer causes largest variations in the DC level.

Accordingly, in conventional cases, this adjustment was typically done by altering the DC level of the common electrode signal supplied by the common electrode signal generator circuit 10.

However, in conventional common electrode signal generator circuits, voltage is always applied to a clamp circuit with resistors. The clamp circuit hence consumes lot of power and could not make a suitable application in the liquid crystal display for use in portable and other electronics where low power consumption was essential.

Figure 3:
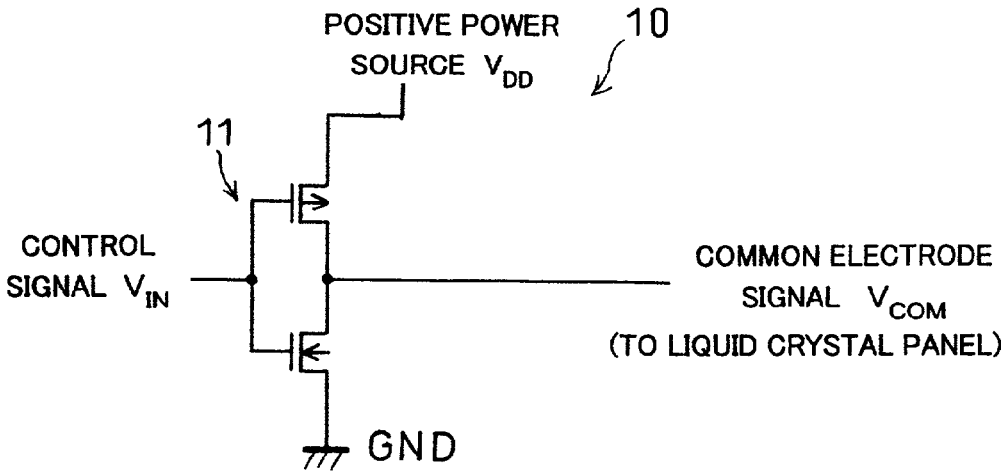
FIG. 3 is a circuit diagram showing an arrangement of a common electrode signal generator circuit in the drive circuit for use in a liquid crystal display.

In the present embodiment, to reduce power consumption by the liquid crystal display, first, as shown in FIG. 3, the common electrode signal generator circuit 10 is composed only of a C-MOS (Complementary Metal Oxide Semiconductor) switch 11 with no clamp circuit included as in a conventional case.

In other words, the common electrode signal generator circuit 10 has an extremely simple arrangement in which the C-MOS switch (switching means) 11 switches between the ground potential GND and the positive power source $V_{DD}$. Therefore, the common electrode signal generator circuit 10 is capable of switching the control signal $V_{IN}$ between two predetermined voltages so as to supply, as a common electrode signal $V_{COM}$, either a 0 V ground potential GND or a D/A-converted alternating signal composed of, for example, a +5 V positive voltage.

The present embodiment is thereby constructed in line with a totally different concept from the conventional one where the common electrode signal generator circuit 10 compensates for the DC level of the common electrode 8 to adjust the potential differences between the pixel electrodes 7 and the common electrode 8.

Besides, the common electrode signal generator circuit 10 includes no clamp circuit or capacitor as in conventional cases; if a supply voltage is maintained at a +5 V positive power source $V_{DD}$ by means of the control signal $V_{IN}$, for example, the common electrode signal $V_{COM}$ can be maintained at +5 V. The common electrode signal generator circuit 10 therefore can be used for low frequency drive and suspension drive.

Meanwhile, as mentioned above, if the DC level is not adjusted by the common electrode signal generator circuit, it has to be adjusted in another way.

Accordingly, in the present embodiment, as the alternative method of adjustment, the reference voltage generator circuit 20 as adjusting means for supplying the reference voltage to the source driver 3 adjusts the potential differences between the pixel electrodes 7 and the common electrode 8 caused by variations in the drain voltages that occur when the TFTs 6 are changed from an ON state to an OFF state.

The following will describe an arrangement of the reference voltage generator circuit 20 to adjust the potential differences between the pixel electrodes 7 and the common electrode 8.

Figure 1:
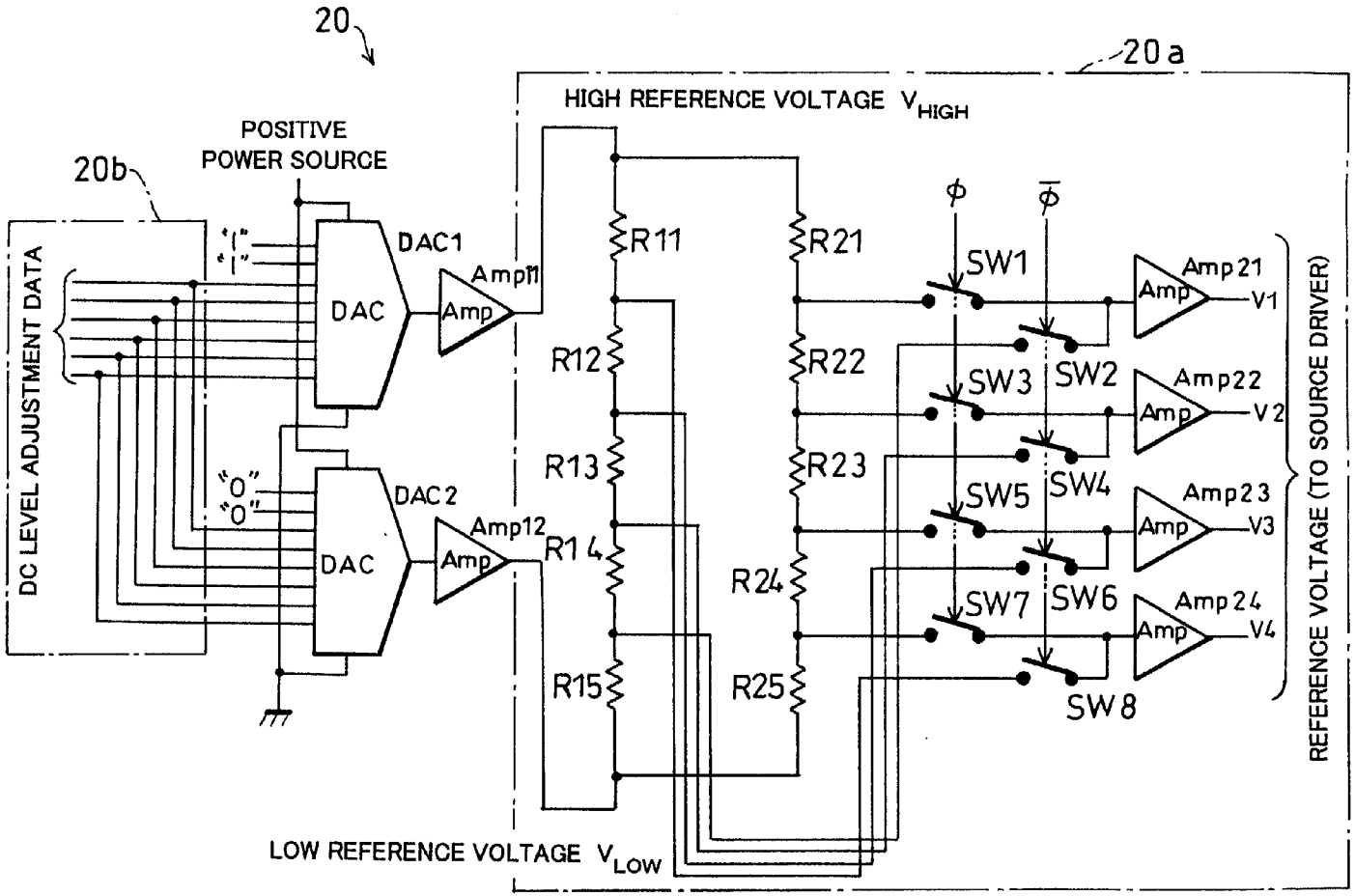
FIG. 1, illustrating an embodiment of the drive circuit for use in a liquid crystal display in accordance with the present invention, is a circuit diagram showing a reference voltage generator circuit for producing a reference voltage for a source driver.

The reference voltage generator circuit 20 of the present embodiment, as shown in FIG. 1, includes a voltage divider section (voltage divider means) 20*a* in which there are provided resistors R11 to R15 and R21 to R25 for dividing the difference between the high reference voltage $V_{HIGH}$ and the low reference voltage $V_{LOW}$ into two sets.

Put differently, the voltage divider section 20*a* includes two groups of resistors, five resistors connected in series in each group, to perform voltage division to produce two sets of four DC voltages from the difference between the high reference voltage $V_{HIGH}$ and the low reference voltage $V_{LOW}$.

Specifically, the five resistors R11 to R15 are connected in series in this order in the first group, with the resistor R11 being coupled to the high reference voltage $V_{HIGH}$ and the resistor R15 being coupled to the low reference voltage $V_{LOW}$. The resistors R11 to R15 have suitable specified resistances. The arrangement enables the first group to output, through the coupling points, DC voltages produced from the difference between the high reference voltage $V_{HIGH}$ and the low reference voltage $V_{LOW}$ through voltage division in accordance with the combined resistances from the low reference voltage $V_{LOW}$ to the coupling points. The coupling points to the resistors are connected to amplifiers Amp21 to Amp24 through switches SW2, SW4, SW6, SW8 controlled in an interconnected manner through the signal $\overline{\phi}$.

Similarly, the arrangement enables the second group, in which the five resistors R21 to R25 are connected in series in this order, to output, through the coupling points to the resistors, DC voltages produced from the difference between the high reference voltage $V_{HIGH}$ and the low reference voltage $V_{LOW}$ through voltage division in accordance with the combined resistances from the low reference voltage $V_{LOW}$ to the coupling points. The coupling points to the resistors are connected to amplifiers Amp21 to Amp24 through switches SW1, SW3, SW5, SW7 controlled in an interconnected manner through the signal $\phi$.

The signals $\phi$ and $\overline{\phi}$ change at identical timings and differ from each other only in that they are of opposite polarities. Therefore, Either one of the switches SW1, SW2 is conducting at any time to feed a DC voltage to an amplifier Amp 21, and so is either one of switches SW3, SW4 to feed a DC voltage to an amplifier Amp 22, one of switches SW5, SW6 to feed a DC voltage to an amplifier Amp 23, and one of switches SW7, SW8 to feed a DC voltage to an amplifier Amp 24. As a result, four DC voltages belonging to one of the sets of voltages produced by the first and second groups and selected through the signals $\phi$ and $\overline{\phi}$ are coupled to the amplifiers Amp21 to Amp24.

As a result, if for example, the switches SW1, SW3, SW5, SW7 controlled in an interconnected manner through the signal $\phi$ are turned on, the difference between the high reference voltage $V_{HIGH}$ and the low reference voltage $V_{LOW}$ is subjected to voltage division by the resistors R21 to R25 to supply reference voltages V1 to V4 to the source driver for use as reference voltages there. Meanwhile, if for example, the switches SW2, SW4, SW6, SW8 controlled in an interconnected manner through the signal $\overline{\phi}$ are turned on, the resistors R11 to R15 divide the difference between the high reference voltage $V_{HIGH}$ and the low reference voltage $V_{LOW}$ to supply reference voltages V'1 to V'4 (not shown) to the source driver for use as reference voltages there.

In other words, the effects of the parasitic capacity of the TFTs 6 on the drain voltage change depending on the voltage applied to the liquid crystal, and the potential differences between the pixel electrodes 7 and the common electrode 8 should be changed for a white display and for a black display. Accordingly, the present embodiment readily divides the difference between the high reference voltage $V_{HIGH}$ and the low reference voltage $V_{LOW}$ into two sets: a set of partial voltages by means of the resistors R21 to R25 and another set of partial voltages by means of the resistors R11 to R15. Therefore, one of the two sets of reference voltages V1 to V4 and reference voltages V'1 to V'4 can be selectively supplied to the source driver 3, so as to readily switch the potential differences between the pixel electrodes 7 and the common electrode 8 for a white or black display.

The high reference voltage $V_{HIGH}$ is produced by a circuit composed of a (high-and-low-reference-voltage-interconnecting means in the previous stage) D/A converter DAC1 and an amplifier Amp 11. The low reference voltage $V_{LOW}$ is produced by a circuit composed of a D/A converter (high-and-low-reference-voltage-interconnecting means) DAC2 and an amplifier Amp 12.

In the present embodiment, common DC level adjustment data is supplied to the D/A converters DAC1, DAC2 as their low-order 6 bits. In other words, to make the output from the amplifier Amp11 equal to the high reference voltage $V_{HIGH}$, the high-order 2 bits are fixed to 1 or high level, and to make the output from the amplifier Amp12 equal to the low reference voltage $V_{LOW}$, the high-order 2 bits are fixed to 0 or low level.

Since the D/A converters DAC1, DAC2 each have 8 bits in the present embodiment, 192 ($=2^7+2^6$) voltage differences are preserved between the high reference voltage $V_{HIGH}$ and the low reference voltage $V_{LOW}$, and 63 ($=2^6-1$) adjustments are possible due to external data. In other words, 63 sets of data can be supplied to the D/A converter DAC1. In contrast to this input data to the D/A converter DAC1, 192 different values can be supplied to the D/A converter DAC2.

Therefore, according to this arrangement, the four partial voltages supplied to the source driver 3, i.e. the reference voltages V1 to V4 or V'1 to V'4, can be shifted while preserving the relationships of the potential differences between the pixel electrodes 7 and the common electrode 8, and a plurality of sets of partial voltages required for gamma correction and nonlinear D-to-A conversion that matches with properties of the liquid crystal, i.e. the reference voltages V1 to V4, V'1 to V'4, V"1 to V"4, can be produced and supplied to the source driver 3. In the present embodiment, the voltage difference between the high reference voltage $V_{HIGH}$ and the low reference voltage $V_{LOW}$ are divided into two sets of partial voltages. This is not the only possibility: the device may be adapted to divide the voltage difference into three or more sets of partial voltages.

Figure 4:
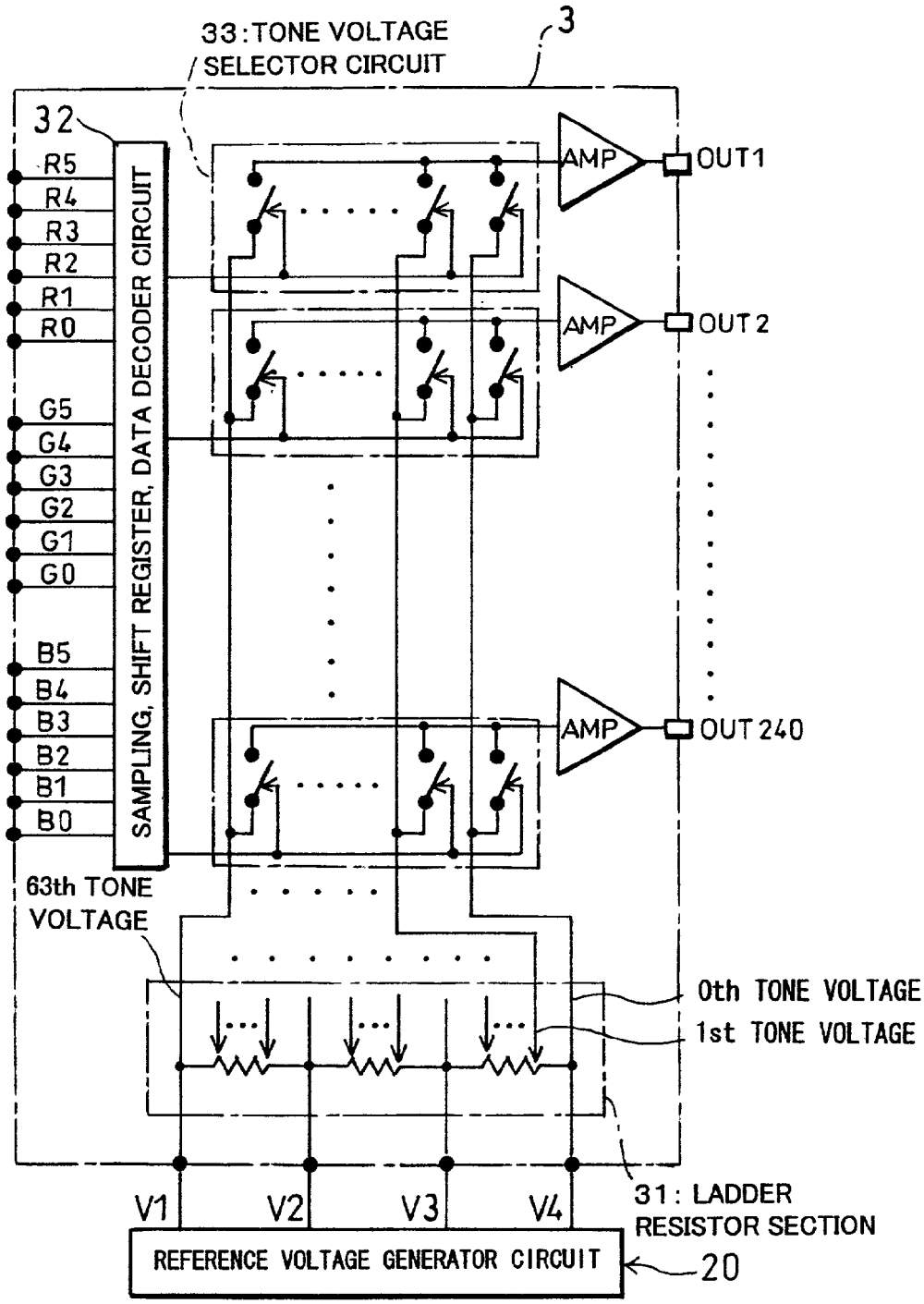
FIG. 4 is a circuit diagram showing an arrangement of a source driver in the drive circuit for use in a liquid crystal display.

The reference voltages V1 to V4 produced by the reference voltage generator circuit 20 are supplied to the source driver 3 that includes an R-DAC which is a D/A converter composed of resistors (see FIG. 4). The R-DAC is constructed of a ladder resistor section 31, a tone voltage selector circuit 33, and amplifiers AMP.

Specifically, the reference voltages V1 to V4 are supplied to the ladder resistor section 31 in the source driver 3, and a graphic signal from the control circuit 4 is supplied to a sampling, shift register, data decoder circuit 32. Based on the graphic data, the tone voltage selector circuits 33 produce source signal voltages which are supplied to the liquid crystal panel 1 via output terminals OUT1 to OUT240.

In the ladder resistor section 31, resistors are used to divide the potential between the reference voltages V1, V4 so that the resultant partial voltages match with 64 tones. In light of this fact, the reference voltages V2 and V3 may seem redundant as long as the reference voltages V1, V4 are available. Still, the four reference voltages V1 to V4 are used here, because the dielectric constant of the liquid crystal is variable depending on applied voltage.

Therefore, FIGS. 4 and 1 show for the sake of simplicity an arrangement where the four reference voltages V1 to V4 are produced. This is not the only possibility: five or more reference voltages V1 to Vn may be produced (n is an integer more than or equal to 5). When this is the case, the liquid crystal panel 1 operates in manners more suited to properties of the liquid crystal.

As detailed in the foregoing, in the drive circuit of the liquid crystal display of the present embodiment, the common electrode signal generator circuit 10 has a very simple arrangement in which the C-MOS switch 11 switches the common electrode signal $V_{COM}$ between the ground potential GND and the positive power source $V_{DD}$.

The simple arrangement of the common electrode signal generator circuit 10 consumes less power than a conventional arrangement in which the DC level is shifted by the use of a clamp circuit and the potential of the low voltage of the common electrode signal $V_{COM}$ is thereby made lower than the ground potential GND.

Conventional clamp circuits have a prerequisite for their operation that they can operate on an AC voltage supply of a frequency close to the horizontal frequency of a graphic signal. The common electrode signal $V_{COM}$ cannot be pegged to one polarity for an extended period of time, and the conventional clamp circuit cannot handle suspension drive and low frequency drive. In the arrangement of the present embodiment, the common electrode signal $V_{COM}$ may be pegged to one polarity and still realize stable operation. More specifically, the common electrode signal generator circuit 10 is only responsible for the switching between the ground potential GND and the positive power source $V_{DD}$, so the common electrode signal $V_{COM}$ can be maintained at a fixed level with more ease during suspension drive. In addition, since the common electrode signal $V_{COM}$ does not experience any unexpected level changes upon switching between suspension drive and ordinary drive, the liquid crystal panel 1 does not flicker upon the switching. This also contributes to preservation of high display quality.

The adjusting means for altering the level voltage of the source signal may be configured so that the high reference voltage $V_{HIGH}$ and the low reference voltage $V_{LOW}$ supplied by the reference voltage generator circuit 20 to the R-DAC in the source driver 3 are variable in an interconnected manner rather than fixed.

The D/A converters DAC1, DAC2 and amplifiers Amp 11, Amp 12 additionally provided in the reference voltage generator circuit 20 for the purpose of DC level adjustment can operate on a low power supply because of the high impedance of the circuit in the subsequent stage. The overall power consumption is thereby reduced by great amounts.

In conventional reference voltage generator circuits, the high reference voltage $V_{HIGH}$ and the low reference voltage $V_{LOW}$ are fixed, for example, to about 4 V and the ground potential GND respectively. In contrast, in the present embodiment, the difference between the high reference voltage $V_{HIGH}$ and the low reference voltage $V_{LOW}$ are interconnected for operation; therefore, the voltage levels of the source signals produced by the source driver 3 can be readily shifted by equal amounts.

Further, the drive circuit for use in a liquid crystal display of the present embodiment runs on a reduced power supply in normal operation. In addition, the drive circuit can operate in other various modes, such as suspension drive and low frequency drive, which differ from normal AC drive, thereby contributing power reduction in these modes too.

The present invention is by no means limited to the above embodiment and may be varied in many ways within its scope. For example, throughout the embodiment, the common electrode signal generator circuit 10 has been disposed together with the common electrode 8. Alternatively, with the aforementioned very simple configuration, the common electrode signal generator circuit 10 may be now readily disposed, for example, inside the source driver 3.

The common electrode signal generator circuit 10, which can be built into the source driver with ease and does not allow the common electrode signal $V_{COM}$ to take a negative voltage value, permits reductions in cost and area required for mounting through circuit integration. Thus, the common electrode signal generator circuit 10 is arranged most suitably for use in portable and other electronics.

In this manner, in the drive circuit for use in a liquid crystal display of the present embodiment, the source signal voltages from the source driver 3 is supplied to the pixel electrodes 7 through the switching by the TFTs 6 in accordance with the scan signals from the gate driver 2. The drive circuit includes adjusting means for adjusting the potential differences between the pixel electrodes 7 and the common electrode 8 to compensate for the effects of variations in the drain voltages caused by parasitic capacity in the TFTs 6. The adjusting means may be adapted to the potential differences between the pixel electrodes 7 and the common electrode 8 to compensate for irregularities in DC voltage component between the drains and the metal film that constitutes the multi-layered pixel electrodes and that is located closer to the liquid crystal layer than the other metal film(s). Alternatively, the adjusting means may be adapted to adjust the potential differences between the pixel electrodes 7 and the common electrode 8 to compensate for irregularities in the DC voltage caused by asymmetry in properties between the active matrix substrate and the opposite substrate sandwiching the liquid crystal layer.

Conventionally, the adjusting means was provided in the common electrode signal generator circuit 10 that supplies voltage to the common electrode 8. In other words, conventionally, to adjust the potential differences between the pixel electrodes 7 and the common electrode 8 for the purposes, among others, of compensating for the effects of variations in the drain voltages caused by parasitic capacity in the TFTs 6, compensating for irregularities in DC voltage component between the drains and the metal film located closer to the liquid crystal layer than the other metal film(s), and compensating for irregularities in the DC voltage caused by asymmetry in properties between the active matrix substrate and the opposite substrate sandwiching the liquid crystal layer, the potential of the common electrode 8 was adjusted.

Further, the conventional adjusting means was arranged so that a voltage was always applied to the resistor built in the clamp circuit that adjusted the potential of the common electrode 8. Therefore, the clamp circuit was power consuming and could not make a suitable application in the drive circuit for use in a liquid crystal display of portable and other electronics where low power consumption was essential.

Besides, the voltage level of the common electrode 8 was not stable without periodic D/A conversions; therefore, the conventional adjusting means had a problem that it could not be used for low frequency drive or suspension drive.

Low frequency drive refers to a method of driving on an alternating current having a low frequency. Suspension drive refers to a method of driving on alternating current of which the reversion is suspended temporarily for a predetermined period. In other words, low frequency drive differs from suspension drive in that the frequency of AC reversion is constant in the former, but varies periodically in the latter.

In light of this, in the present embodiment, the adjusting means is part of the reference voltage generator circuit 20 as voltage level altering means for shifting the voltage levels of the source signals supplied by the source driver 3 equally for all the pixel electrodes 7.

In other words, the present embodiment is adopting the method of adjusting the voltage levels of the source signals supplied by the source driver 3, so as to, for example, adjust the potential differences between the pixel electrodes 7 and the common electrode 8 for the purpose of compensating for the effects of variations in the drain voltages caused by parasitic capacity in the TFTs 6; the voltage levels of the source signals are shifted equally for all the pixel electrodes 7 by the reference voltage generator circuit 20 that feeds a reference voltage to the source driver 3.

As a result, the potential of the common electrode 8 can be fixed. This makes unnecessary the conventionally indispensable clamp circuit including a resistor for voltage adjustment and eliminates possibilities of increased power consumption due to the presence of a clamp circuit. The elimination of the clamp circuit and capacitor makes it possible to use the drive circuit for low frequency drive and suspension drive.

Therefore, the drive circuit for use in a liquid crystal display is applicable to portable and other electronics operative without necessarily performing periodical D/A conversions and includes the adjusting means running on a reduced power supply to adjust the potential differences between the pixel electrodes 7 and the common electrode 8 for the purposes of compensating for variations in the drain voltages, irregularities in DC voltage component between the drains and the metal film that constitutes the multi-layered pixel electrode and that is located closer to the liquid crystal layer than the other metal film(s), and irregularities in the DC voltage caused by asymmetry in properties between the active matrix substrate and the opposite substrate sandwiching the liquid crystal layer.

In the drive circuit for use in a liquid crystal display of the present embodiment, the voltage level altering means is provided in the reference voltage generator circuit 20 producing the reference voltages V1 to V4 from which the source driver 3 produces the source signal voltages.

The voltage level altering means includes: the voltage divider section 20*a* as the voltage divider means for dividing the voltage difference between the high reference voltage $V_{HIGH}$ and the low reference voltage $V_{LOW}$ with the resistors R11 to R15 or R21 to R25 to supply reference voltages V1 to V4 as outputs; D/A converters DAC1, DAC for altering the high reference voltage $V_{HIGH}$ and the low reference voltage $V_{LOW}$ in an interconnected manner; and a low-reference-voltage-specifying section 20*b* as low-reference-voltage-specifying means for specifying the ratio of the low reference voltage $V_{LOW}$ to the high reference voltage $V_{HIGH}$.

Therefore, in the reference voltage generator circuit 20 producing the reference voltages V1 to V4 from which the source driver 3 produces the source signal voltages, first, the low-reference-voltage-specifying section 20*b* specifies the ratio of the low reference voltage $V_{LOW}$ to the high reference voltage $V_{HIGH}$. The ratio of the low reference voltage $V_{LOW}$ is determined, for example, so as to compensate for the effects of variations in the drain voltages caused by parasitic capacity in the TFTs 6.

Subsequently, the D/A converters DAC1, DAC2 alter the high reference voltage $V_{HIGH}$ and the low reference voltage $V_{LOW}$ in an interconnected manner; therefore, for example, the potential difference between the high reference voltage $V_{HIGH}$ and the low reference voltage $V_{LOW}$ determined in consideration of the effects of variations in the drain voltages can be preserved.

Next, the voltage divider section 20*a* divides the potential difference between the high reference voltage $V_{HIGH}$ and the low reference voltage $V_{LOW}$ with, for example, the resistor resistors R21 to R25 to supply the reference voltages V1 to V4 as outputs.

As a result, the source driver 3 receives, for example, the reference voltages V1 to V4 determined in consideration of the effects of variations in the drain voltages and in turn supplies to the pixel electrodes 7 the source signal at the voltage levels determined in consideration of the effects of variations in the drain voltages and other factors.

For example, the effects of variations in the drain voltages differ from one liquid crystal panel to another; the variations can be compensated for by adapting the low-reference-voltage-specifying section 20*b* in the reference voltage generator circuit 20 to renew the ratio of the low reference voltage $V_{LOW}$ to the high reference voltage $V_{HIGH}$. Thus, the voltage levels of the source signals supplied by the source driver 3 are shifted equally for all the pixel electrodes 7.

This arrangement gives a concrete construction of the reference voltage generator circuit 20 to serve as the adjusting means. Unquestionably, the drive circuit for use in a liquid crystal display is applicable to portable and other electronics operative without necessarily performing periodical D/A conversions and includes the adjusting means running on a reduced power supply to compensate for the variations in the drain voltages and other purposes.

Further, in the drive circuit for use in a liquid crystal display of the present embodiment, the voltage divider section 20*a* is adapted to be capable of, when dividing the voltage difference between the high reference voltage $V_{HIGH}$ and the low reference voltage $V_{LOW}$, selectively supplying as outputs either of two sets of partial voltages, as the aforementioned plurality of sets, i.e., the reference voltages V1 to V4 and the reference voltages V'1 to V'4. Specifically, to this end, the resistors R21 to R25 and the resistors R11 to R15 are selectively used.

In other words, the effects of parasitic capacity of the TFTs 6 on the drain voltages change with the voltage applied to liquid crystal. Therefore, the potential differences between the pixel electrodes 7 and the common electrode 8 needs be changed for a white display and a black display. In the present embodiment, the potential differences between the pixel electrodes 7 and the common electrode 8 is readily changed for a white display and a black display, since the voltage divider section 20*a* is adapted to be capable of, when dividing the voltage difference between the high reference voltage $V_{HIGH}$ and the low reference voltage $V_{LOW}$, selectively supplying as outputs either of two sets of partial voltages, i.e., the reference voltages V1 to V4 and the reference voltages V'1 to V'4.

As a result, the drive circuit for use in a liquid crystal display is highly functional.

Further, in the drive circuit for use in a liquid crystal display of the present embodiment is there provided the common electrode signal generator circuit 10 including the C-MOS switch 11 only for switching between the ground potential GND and the positive power source $V_{DD}$ to give a fixed potential to the common electrode 8.

As a result, it is ensured that the potential of the common electrode 8 is fixed. Thus, the drive circuit no longer requires a conventionally indispensable clamp circuit with resistors for voltage adjustment, which eliminates possibilities of increased power consumption due to the presence a clamp circuit. The elimination of the clamp circuit and capacitor makes it possible to use the drive circuit for low frequency drive and suspension drive.

Therefore, unquestionably, the drive circuit for use in a liquid crystal display is applicable to portable and other electronics operative without necessarily performing periodical D/A conversions and includes the adjusting means running on a reduced power supply to compensate for the variations in the drain voltages and other purposes.

Further, in the drive circuit for use in a liquid crystal display of the present embodiment, the common electrode signal generator circuit 10 can be built in the source driver 3.

In other words, the common electrode signal generator circuit 10 produces a common electrode signal $V_{COM}$ that is never lower than the ground potential GND and because of its simple arrangement, can be readily built in the source driver 3.

The provision of the common electrode signal generator circuit 10 in the source driver 3 would enable cost reductions by way of integrated circuitry.

The liquid crystal display of the present embodiment includes the foregoing drive circuit for use in a liquid crystal display.

Therefore, the liquid crystal display, whether it be reflective, opaque, reflective/transparent, transparent, or of any other type, is applicable to portable and other electronics operative without necessarily performing periodical D/A conversions and includes the adjusting means running on a reduced power supply to compensate for the variations in the drain voltages and other purposes.

The electronics of the present embodiment include the foregoing liquid crystal display.

Therefore, the electronics, including a mobile telephone, personal data assistant (PDA), notebook personal computer, portable television set, portable game machine, or other portable appliance, are applicable to portable electronics operative without necessarily performing periodical D/A conversions and includes the adjusting means running on a reduced power supply to compensate for the variations in the drain voltages and other purposes.

Embodiment 2

Figure 5:
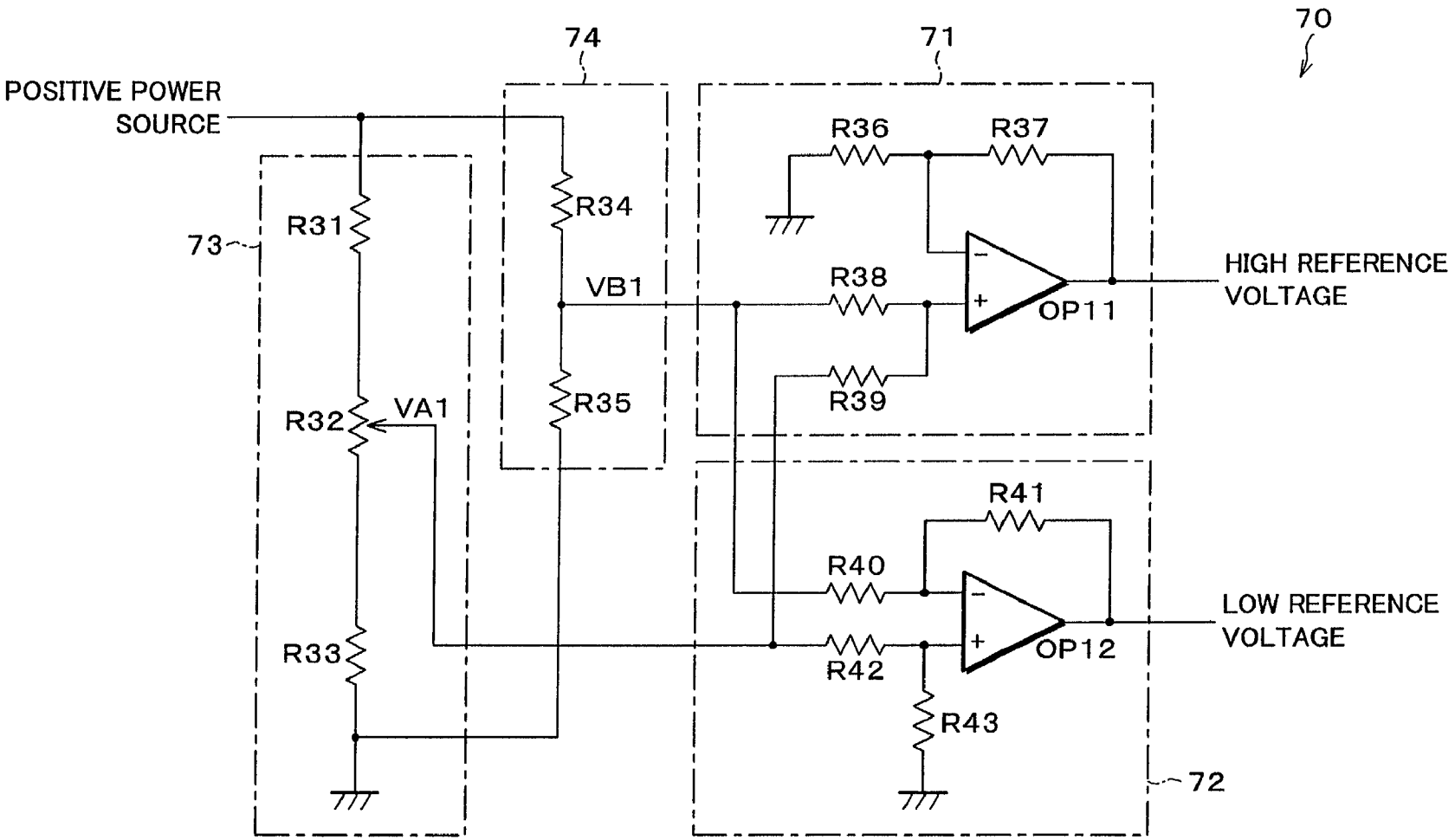
FIG. 5, illustrating another embodiment of the drive circuit for use in a liquid crystal display in accordance with the present invention, is a circuit diagram showing an high-and-low-reference-voltage-interconnecting section composed of an OP-amplifier-based voltage adder circuit and an OP-amplifier-based voltage subtractor circuit.
Figure 6:
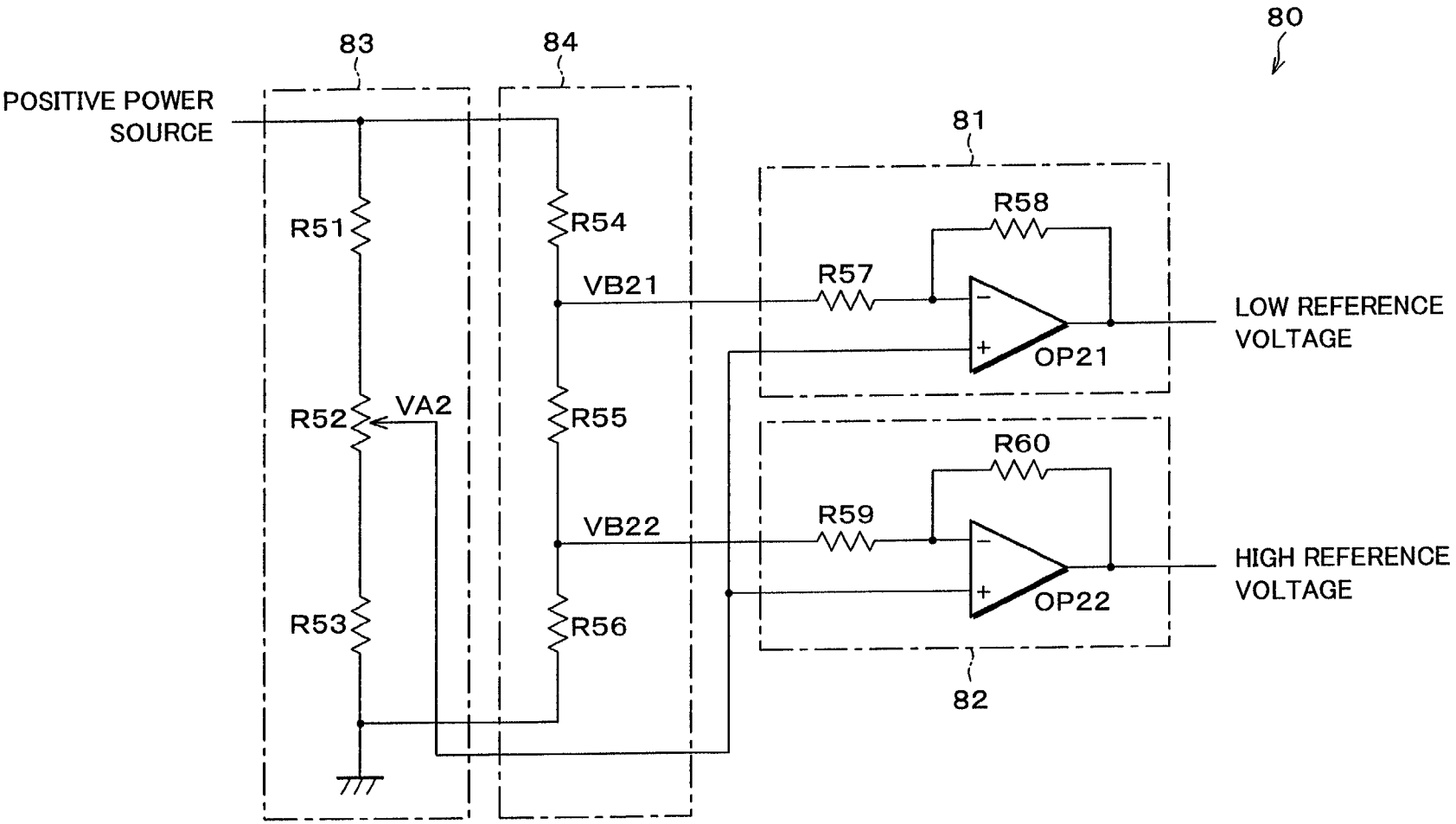
FIG. 6 is a circuit diagram showing an high-and-low-reference-voltage-interconnecting section composed of a first OP-amplifier-based inverter-amplifier circuit and a second OP-amplifier-based inverter-amplifier circuit.
Figure 7:
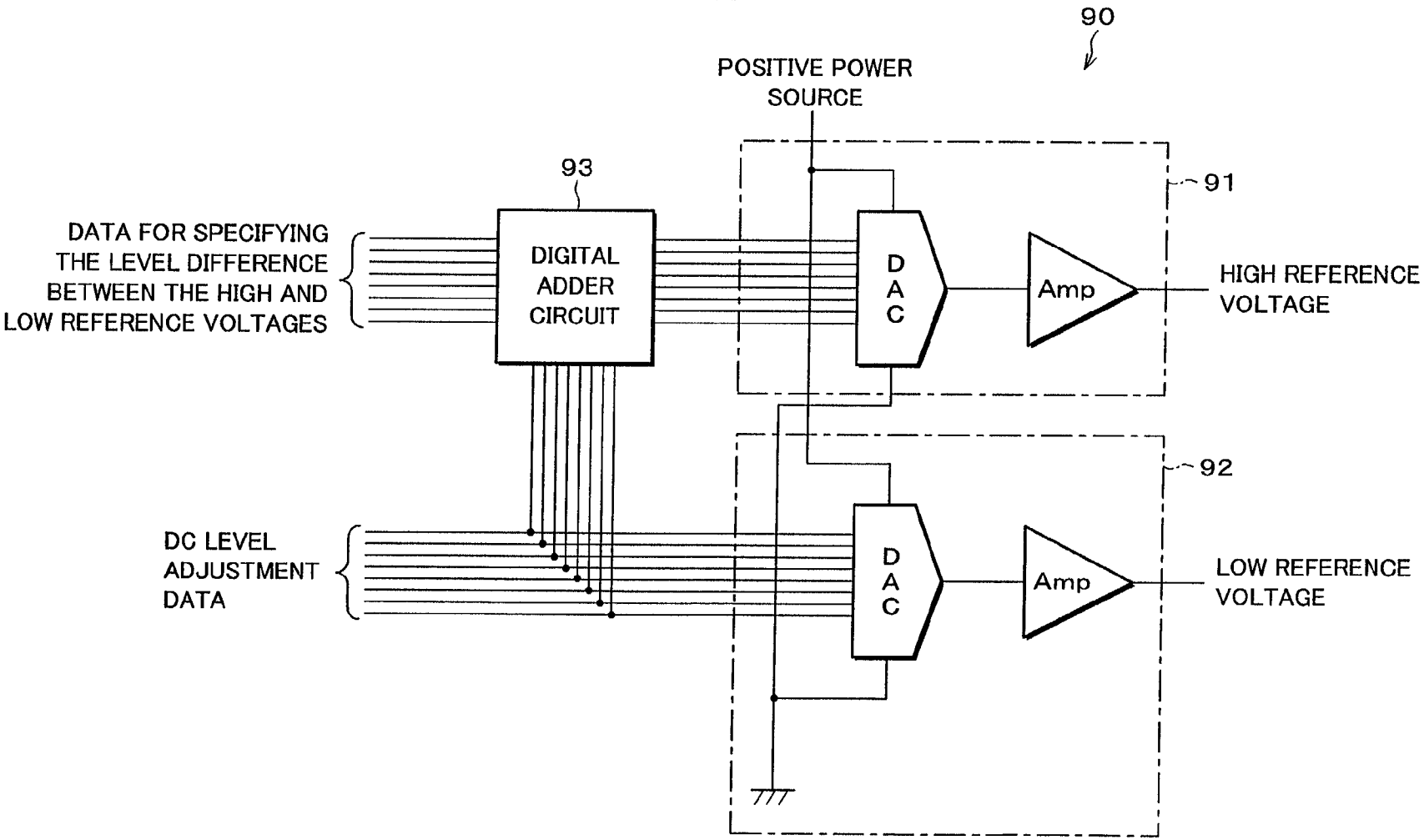
FIG. 7 is a circuit diagram showing an high-and-low-reference-voltage-interconnecting section composed of a low-reference-voltage-producing D/A conversion circuit, a digital adder circuit for adding data for specifying the level difference between the high and low reference voltages with data for adjusting the DC level, and an high-reference-voltage-producing D/A conversion circuit.
Figure 8:
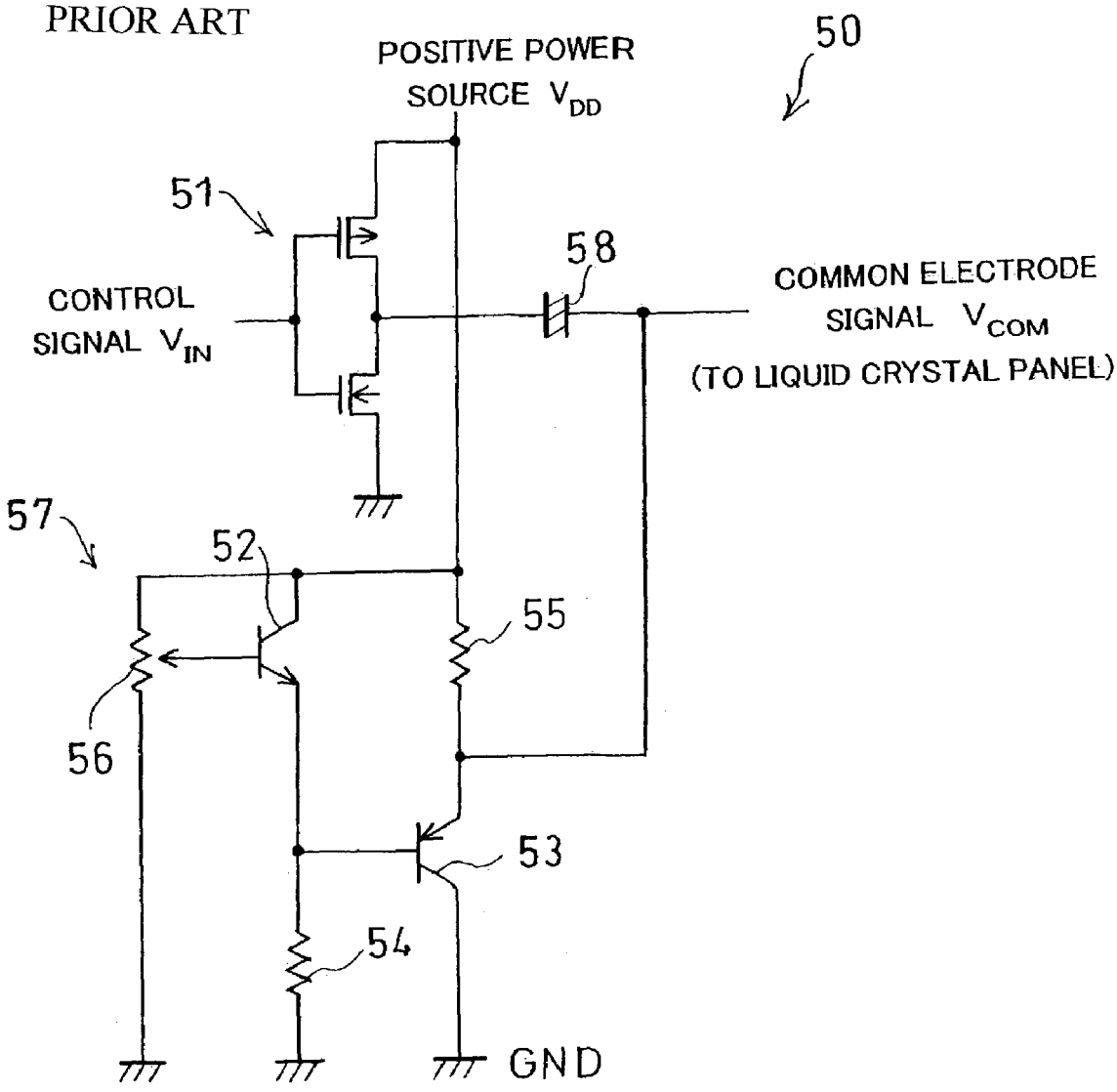
FIG. 8 PRIOR ART
FIG. 8 is a circuit diagram showing an arrangement of a common electrode signal generator circuit in a conventional drive circuit for use in a liquid crystal display.
Figure 9:
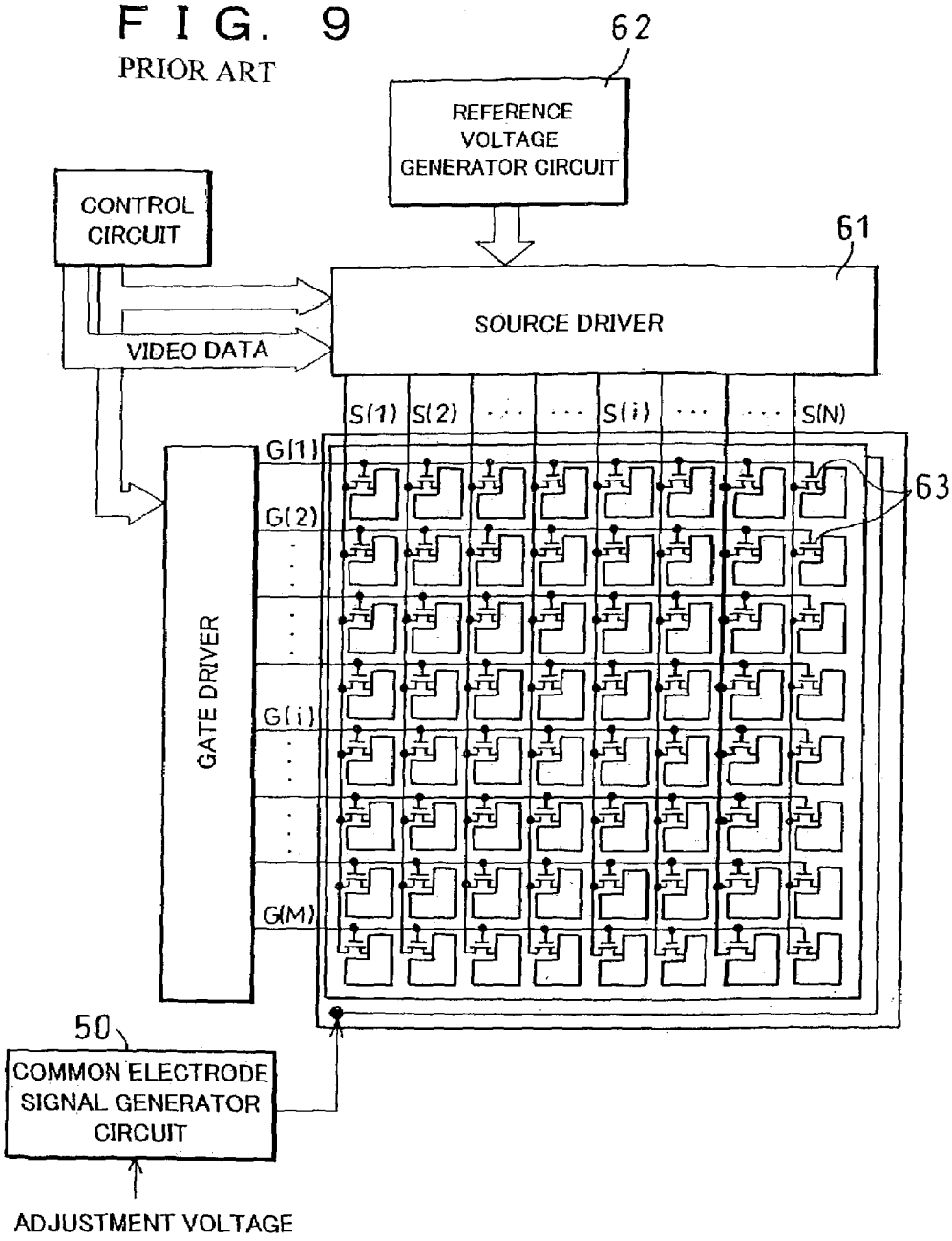
FIG. 9 PRIOR ART
FIG. 9 is a schematic showing the overall construction of the drive circuit for use in a liquid crystal display.
Figure 10:
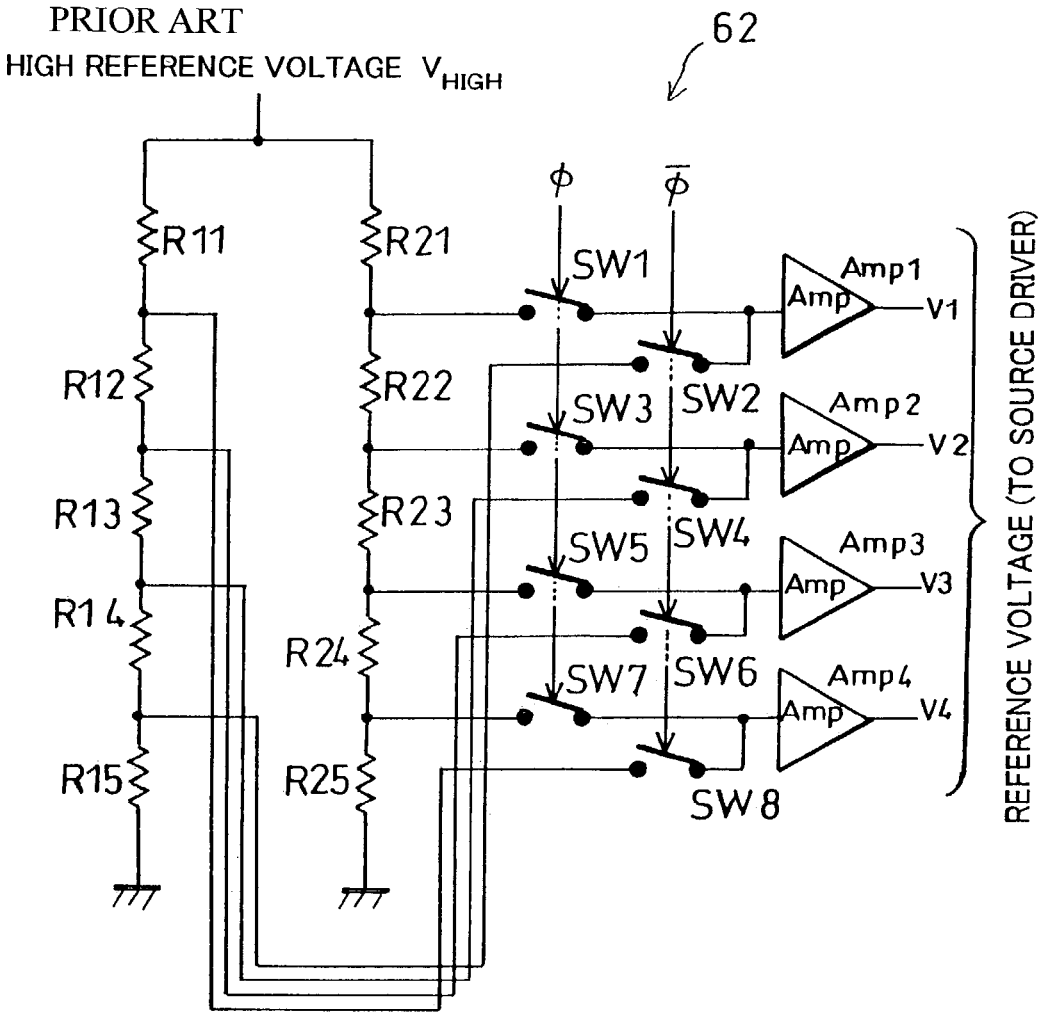
FIG. 10 PRIOR ART
FIG. 10 is a circuit diagram showing a reference voltage generator circuit for producing a reference voltage for a source driver in the drive circuit for use in a liquid crystal display.

In reference to FIGS. 5 through 7, the following will describe another embodiment in accordance with the present invention. Here, for convenience, members of the present embodiment that have the same arrangement and function as members of embodiment 1, and that are mentioned in that embodiment are indicated by the same reference numerals and description thereof is omitted. The features of embodiment 1 are applicable in the present embodiment along with other new features.

In the present embodiment, the high-and-low-reference-voltage-interconnecting means will be further described by way of several examples.

As shown in FIG. 5, an high-and-low-reference-voltage-interconnecting section 70, which is an example of the high-and-low-reference-voltage-interconnecting means, includes a voltage adder circuit 71 composed of an OP-amplifier OP11 and resistors R36, R37, R38, R39; a voltage subtractor circuit 72 composed of an OP-amplifier OP12 and resistors R40, R41, R42, R43; a first bias circuit 73 composed of a resistor R31, a variable resistor R32, and a resistor R33; and a second bias circuit 74 composed of resistors R34, R35.

In the high-and-low-reference-voltage-interconnecting section 70, the OP-amplifier OP11 supplies as an output a voltage VA1+VB1, i.e., the result of addition of the voltage VA1 produced by the first bias circuit 73 with the voltage VB1 produced by the second bias circuit 74.

Meanwhile, the OP-amplifier OP12 supplies as an output a voltage value VA1−VB1, i.e., the result of subtraction of the voltage VA1 produced by the first bias circuit 73 and the voltage VB1 produced by the second bias circuit 74 with each other.

Therefore, using the output from the OP-amplifier OP11 as an high reference voltage and the output from the OP-amplifier OP12 as a low reference voltage, the high-and-low-reference-voltage-interconnecting section 70 functions as high-and-low-reference-voltage-interconnecting means for altering two reference voltages in an interconnected manner.

In other words, the voltage VB1 produced by the second bias circuit 74 specifies the difference between the high reference voltage and the low reference voltage. The difference between the output voltage VA1+VB1 from the OP-amplifier OP11 and the output voltage VA1−VB1 from the OP-amplifier OP12 is always sustained at 2×VB1, no matter what value the voltage VA1 takes.

The voltage VA1 produced by the first bias circuit 73 is varied in value through the variable resistor R32. Therefore, the output voltages from the OP-amplifiers OP11, OP12 shows a DC level that is variable according to the variable voltage VA1, while maintaining their difference at a fixed value.

An high-and-low-reference-voltage-interconnecting section 80 is shown in FIG. 6 as another example of the high-and-low-reference-voltage-interconnecting means.

The high-and-low-reference-voltage-interconnecting section 80, as shown in the figure, includes: a first inverter-amplifier circuit 81 composed of an OP-amplifier OP21 and resistors R57, R58; a second inverter-amplifier circuit 82 composed of an OP-amplifier OP22 and resistors R59, R60; a first bias circuit 83 composed of a resistor R51, a variable resistor R52, and a resistor R53; and a second bias circuit 84 composed of resistors R54, R55, R56.

Using the output voltage from the OP-amplifier OP21 as a low reference voltage and the output voltage from the OP-amplifier OP22 as an high reference voltage, the high-and- low-reference-voltage-interconnecting section 80 functions as high-and-low-reference-voltage-interconnecting means for altering two reference voltages in an interconnected manner.

Specifically, for example, when the resistors R57, R58 have equal resistance values, the OP-amplifier OP21 supplies VA2−(VB21−VA2) as an output. Meanwhile, when the resistors R59, R60 have equal resistance values, the OP-amplifier OP22 supplies VA2−(VB22−VA2) as an output.

Under these conditions, the OP-amplifiers OP22, OP21 produce a voltage difference VB21−VB22, and this difference is maintained regardless of the value of the voltage VA2 produced by the first bias circuit 83.

In contrast, the voltage VA2 produced by the first bias circuit 83 is varied in value through the variable resistor R52. As is clear from the above mathematical expressions, when the voltage VA2 produced by the first bias circuit 83 varies in value, the output voltages from the OP-amplifiers OP21, OP22 are varied by an amount two times the variation of the voltage VA2 because of the term, 2×VA2.

Therefore, the output voltages from the OP-amplifiers OP21, OP12 shows a DC level that is variable according to the variable voltage VA2 produced by the first bias circuit 83, while maintaining their difference at a fixed value.

An high-and-low-reference-voltage-interconnecting section 90 is shown in FIG. 7 as another example of the high-and-low-reference-voltage-interconnecting means. The high-and-low-reference-voltage-interconnecting section 90 as described in embodiment 1 is a modification example that includes a circuit composed of the D/A converter DAC1 and an amplifier Amp 11 and a circuit composed of the D/A converter DAC2 and the amplifier Amp 12.

In other words, the high-and-low-reference-voltage-interconnecting section 90, as shown in the figure, produces an high reference voltage and a low reference voltage by means of two D/A conversion circuits, i.e., an high-reference-voltage-producing D/A conversion circuit 91 and a low-reference-voltage-producing D/A conversion circuit 92, and is adapted to only varies the DC level of the high and low reference voltages at a fixed value, while maintaining the difference between them. In other words, in comparison with the example in embodiment 1, the difference can be found where the high-order 2 bits of the each D/A converter DAC1, DAC2 are fixed to high level or low level, i.e., "1" or "0."

In the high-and-low-reference-voltage-interconnecting section 90, the low-reference-voltage-producing D/A conversion circuit 92 directly receives an input of DC level adjustment data as conversion data. Meanwhile, the digital adder circuit 93 adds the high-and-low-reference-voltage-level-difference-specifying data with DC level adjustment data specified in advance, and the data obtained here is supplied as conversion data to the high-reference-voltage-producing D/A conversion circuit 91.

With the configuration, by varying the DC level adjustment data, the DC levels of the high and low reference voltages can be varied while maintaining the voltage difference given by the high-and-low-reference-voltage-level-difference-specifying data.

As described in the foregoing, in the present embodiment, the high-and-low-reference-voltage-interconnecting section (high-and-low-reference-voltage-interconnecting means) 70 includes the voltage adder circuit 71 as an adder circuit provided with the OP-amplifier OP11 to add the two sets of the produced voltages VA2, VB1 with each other to supply the high reference voltage as an output and the voltage subtractor circuit 72 as a subtractor circuit provided with the OP-amplifier OP12 to subtract the two sets of produced voltages VA1, VB1 with each other to supply the low reference voltage as an output. This enables the two reference voltages, i.e., the high and low reference voltages, to be altered in an interconnected manner. This is how the high-and-low-reference-voltage-interconnecting means is specifically made.

In the present embodiment, the high-and-low-reference-voltage-interconnecting section (high-and-low-reference-voltage-interconnecting means) 80 includes the first inverter-amplifier circuit 81 provided with the OP-amplifier OP21 to supply as an output the low reference voltage from the two sets of produced voltages VA2, VB21 and the second inverter-amplifier circuit 82 provided with the OP-amplifier OP22 to supply as an output the high reference voltage from the two sets of produced voltages VA2, VB22. This enables the two reference voltages, i.e., the high reference voltage and the low reference voltage, to be altered in an interconnected manner. This is how the high-and-low-reference-voltage-interconnecting means is specifically made.

In the present embodiment, the high-and-low-reference-voltage-interconnecting section (high-and-low-reference-voltage-interconnecting means) 90 includes the low-reference-voltage-producing D/A conversion circuit 92 for receiving DC level adjustment data and supplying the low reference voltage as an output; the digital adder circuit 93 for adding the high-and-low-reference-voltage-level-difference-specifying data with the DC level adjustment data; and the high-reference-voltage-producing D/A conversion circuit 91 for receiving this addition data supplied by the digital adder circuit 93 and supplying the high reference voltage as an output.

This enables the two reference voltages, i.e., the high reference voltage and the low reference voltage, to be altered in an interconnected manner. This is how the high-and-low-reference-voltage-interconnecting means is specifically made.

The drive circuit for use in a liquid crystal display in accordance with the present invention may supply the source signal voltages from the source driver to the pixel electrodes through switching by means of the thin film transistors according to the scan signals from the gate driver and include adjusting means for adjusting the potential differences between the pixel electrodes and the common electrode, wherein the adjusting means is composed of voltage level altering means for shifting the voltage levels of the source signals supplied by the source driver equally for all the pixel electrodes.

According to the foregoing invention, the drive circuit for use in a liquid crystal display supplies the source signal voltages from the source driver to the pixel electrodes through switching by means of the thin film transistors according to the scan signals from the gate driver.

Conventionally, the adjusting means was provided in the common electrode signal generator circuit that supplies voltage to the common electrode. In other words, conventionally, to adjust the potential differences between the pixel electrodes and the common electrode, the potential of the common electrode was adjusted.

The conventional adjusting means was arranged so that a voltage was always applied to the resistor built in the clamp circuit that adjusted the potential of the common electrode. Therefore, the clamp circuit was power consuming and could not make a suitable application in the drive circuit for use in a liquid crystal display of portable and other electronics where low power consumption was essential.

Besides, the voltage level of the common electrode was not stable without periodic D/A conversions; therefore, the conventional adjusting means had a problem that it could not be used for low frequency drive or suspension drive.

To solve these problem, in the present invention, the adjusting means is composed of voltage level altering means for shifting the voltage levels of the source signals supplied by the source driver equally for all the pixel electrodes.

In other words, the present invention is adopting the method of adjusting the voltage levels of the source signals supplied by the source driver, so as to, for example, adjust the potential differences between the pixel electrodes and the common electrode for the purpose of compensating for the effects of variations in the drain voltages caused by the presence of parasitic capacity in the thin film transistors; the voltage level altering means shifts the voltage levels of the source signals equally for all the pixel electrodes.

As a result, the drive circuit for use in a liquid crystal display in accordance with the present invention is capable of maintaining the potential of the common electrode at a fixed value and no longer requires a conventionally indispensable clamp circuit with resistors for voltage adjustment, which eliminates possibilities of increased power consumption due to the presence of a clamp circuit. The elimination of the clamp circuit and capacitor makes it possible to use the drive circuit for low frequency drive and suspension drive.

Therefore, the drive circuit for use in a liquid crystal display is applicable to portable and other electronics operative without necessarily performing periodical D/A conversions and includes the adjusting means running on a reduced power supply to adjust the potential differences between the pixel electrodes and the common electrode.

Alternatively, the drive circuit for use in a liquid crystal display in accordance with the present invention may supply the source signal voltages from the source driver to the pixel electrodes through switching by means of the thin film transistors according to the scan signals from the gate driver and include adjusting means for adjusting the potential differences between the pixel electrodes and the common electrode for the purpose of compensating for the effects of variations in the drain voltages caused by the presence of parasitic capacity in the thin film transistors, wherein the adjusting means is composed of voltage level altering means for shifting the voltage levels of the source signals supplied by the source driver equally for all the pixel electrodes.

According to the foregoing invention, the drive circuit for use in a liquid crystal display includes adjusting means for adjusting the potential differences between the pixel electrodes and the common electrode for the purpose of compensating for the effects of variations in the drain voltages caused by the presence of parasitic capacity in the thin film transistors.

Conventionally, the adjusting means was provided in the common electrode signal generator circuit that supplies voltage to the common electrode. In other words, conventionally, to adjust the potential differences between the pixel electrodes and the common electrode for the purpose of compensating for the effects of variations in the drain voltages caused by the presence of parasitic capacity in the thin film transistors, the potential of the common electrode was adjusted.

The conventional adjusting means was arranged so that a voltage was always applied to the resistor built in the clamp circuit that adjusted the potential of the common electrode. Therefore, the clamp circuit was power consuming and could not make a suitable application in the drive circuit for use in a liquid crystal display of portable and other electronics where low power consumption was essential.

Besides, the voltage level of the common electrode was not stable without periodic D/A conversions; therefore, the conventional adjusting means had a problem that it could not be used for low frequency drive or suspension drive.

To solve these problem in the present invention, the adjusting means is composed of voltage level altering means for shifting the voltage levels of the source signals supplied by the source driver equally for all the pixel electrodes.

In other words, the present invention is adopting the method of adjusting the voltage levels of the source signals supplied by the source driver, so as to adjust the potential differences between the pixel electrodes and the common electrode for the purpose of compensating for the effects of variations in the drain voltages caused by the presence of parasitic capacity in the thin film transistors; the voltage level altering means shifts the voltage levels of the source signals equally for all the pixel electrodes.

As a result, the drive circuit for use in a liquid crystal display in accordance with the present invention is capable of maintaining the potential of the common electrode at a fixed value and no longer requires a conventionally indispensable clamp circuit with resistors for voltage adjustment, which eliminates possibilities of increased power consumption due to the presence of a clamp circuit. The elimination of the clamp circuit and capacitor makes it possible to use the drive circuit for low frequency drive and suspension drive.

Therefore, the drive circuit for use in a liquid crystal display is applicable to portable and other electronics operative without necessarily performing periodical D/A conversions and includes the adjusting means running on a reduced power supply to compensate for the variations in the drain voltages.

Alternatively, the drive circuit in a liquid crystal display in accordance with the present invention may supply the source signal voltages from the source driver to the pixel electrodes made of a plurality of kinds of metal film layers through switching by means of the thin film transistors according to the scan signals from the gate driver and includes adjusting means for adjusting the potential differences between the pixel electrodes and the common electrode, so as to compensate for irregularities in DC voltage component between the drains of the thin film transistors and one of the plurality of kinds of metal film layers that constitutes the pixel electrodes electrically connected to the drains and that is located closer to the liquid crystal layer than the other metal film(s), wherein the adjusting means is composed of voltage level altering means for shifting the voltage levels of the source signals supplied by the source driver equally for all the pixel electrodes.

According to the foregoing invention, the drive circuit for use in a liquid crystal display includes adjusting means for adjusting the potential differences between the pixel electrodes and the common electrode. The provision of the adjusting means serves not only the need to compensate for the effects of variations in the drain voltages caused by the presence of parasitic capacity in the thin film transistors, but also the need to compensate, when the pixel electrodes are made of a plurality of kinds of metal film layers, for irregularities in DC voltage component between the drains of the thin film transistors and one of the plurality of kinds of metal film layers that constitutes the pixel electrodes electrically connected to the drains and that is located closer to the liquid crystal layer than the other metal film(s).

Conventionally, the adjusting means was provided in the common electrode signal generator circuit that supplies voltage to the common electrode. In other words, conventionally, to adjust the potential differences between the pixel electrodes and the common electrode for the purpose of compensating for irregularities in DC voltage component between the drains and the metal film located closer to the liquid crystal layer than the other metal film(s), the potential of the common electrode was adjusted.

The conventional adjusting means was arranged so that a voltage was always applied to the resistor built in the clamp circuit that adjusted the potential of the common electrode. Therefore, the clamp circuit was power consuming and could not make a suitable application in the drive circuit for use in a liquid crystal display of portable and other electronics where low power consumption was essential.

Besides, the voltage level of the common electrode was not stable without periodic D/A conversions; therefore, the conventional adjusting means had a problem that it could not be used for low frequency drive or suspension drive.

To solve these problem, in the present invention, the adjusting means is composed of voltage level altering means for shifting the voltage levels of the source signals supplied by the source driver equally for all the pixel electrodes.

In other words, the present invention is adopting the method of adjusting the voltage levels of the source signals supplied by the source driver, so as to adjust the potential differences between the common electrode and the pixel electrodes made of a plurality of kinds of metal film layers for the purpose of compensating for irregularities in DC voltage component between the drains and the metal film located closer to the liquid crystal layer than the other metal film(s); the voltage level altering means shifts the voltage levels of the source signals equally for all the pixel electrodes.

As a result, the drive circuit for use in a liquid crystal display in accordance with the present invention is capable of maintaining the potential of the common electrode at a fixed value and no longer requires a conventionally indispensable clamp circuit with resistors for voltage adjustment, which eliminates possibilities of increased power consumption due to the presence of a clamp circuit. The elimination of the clamp circuit and capacitor makes it possible to use the drive circuit for low frequency drive and suspension drive.

Therefore, the drive circuit for use in a liquid crystal display is applicable to portable and other electronics operative without necessarily performing periodical D/A conversions and includes the adjusting means running on a reduced power supply to compensate, when the pixel electrodes are made of a plurality of kinds of metal film layers, for irregularities in DC voltage component between the drains and the metal film located closer to the liquid crystal layer than the other metal film(s).

Alternatively, the drive circuit in a liquid crystal display in accordance with the present invention may supply the source signal voltages from the source driver to the pixel electrodes through switching by means of the thin film transistors according to the scan signals from the gate driver and includes adjusting means for adjusting the potential differences between the pixel electrodes and the common electrode, so as to compensate for irregularities in the DC voltage caused by asymmetry in properties between the active matrix substrate and the opposite substrate sandwiching the liquid crystal layer, wherein the adjusting means is composed of voltage level altering means for shifting the voltage levels of the source signals supplied by the source driver equally for all the pixel electrodes.

According to the foregoing invention, the drive circuit for use in a liquid crystal display includes adjusting means for adjusting the potential differences between the pixel electrodes and the common electrode. The provision of the adjusting means serves not only the need to compensate for the effects of variations in the drain voltages caused by the presence of parasitic capacity in the thin film transistors, but also other needs including the need to compensate for irregularities in the DC voltage caused by asymmetry in properties between the active matrix substrate and the opposite substrate sandwiching the liquid crystal layer. Among various kinds of asymmetry causing the irregularities in the DC voltage, the asymmetry resulting from difference in material between the electrodes positioned oppositely across the liquid crystal layer is more affecting than others.

Conventionally, the adjusting means was provided in the common electrode signal generator circuit that supplies voltage to the common electrode. In other words, conventionally, to adjust the potential differences between the pixel electrodes and the common electrode for the purpose of compensating for irregularities in the DC voltage caused by asymmetry in properties between the active matrix substrate and the opposite substrate sandwiching the liquid crystal layer, the potential of the common electrode was adjusted.

The conventional adjusting means was arranged so that a voltage was always applied to the resistor built in the clamp circuit that adjusted the potential of the common electrode. Therefore, the clamp circuit was power consuming and could not make a suitable application in the drive circuit for use in a liquid crystal display of portable and other electronics where low power consumption was essential.

Besides, the voltage level of the common electrode was not stable without periodic D/A conversions; therefore, the conventional adjusting means had a problem that it could not be used for low frequency drive or suspension drive.

To solve these problem, in the present invention, the adjusting means is composed of voltage level altering means for shifting the voltage levels of the source signals supplied by the source driver equally for all the pixel electrodes.

In other words, the present invention is adopting the method of adjusting the voltage levels of the source signals supplied by the source driver, so as to adjust the potential differences between the pixel electrodes and the common electrode for the purpose of compensating for irregularities in the DC voltage caused by asymmetry in properties between the active matrix substrate and the opposite substrate sandwiching the liquid crystal layer; the voltage level altering means shifts the voltage levels of the source signals equally for all the pixel electrodes.

As a result, the drive circuit for use in a liquid crystal display in accordance with the present invention is capable of maintaining the potential of the common electrode at a fixed value and no longer requires a conventionally indispensable clamp circuit with resistors for voltage adjustment, which eliminates possibilities of increased power consumption due to the presence of a clamp circuit. The elimination of the clamp circuit and capacitor makes it possible to use the drive circuit for low frequency drive and suspension drive.

Therefore, the drive circuit for use in a liquid crystal display is applicable to portable and other electronics operative without necessarily performing periodical D/A conversions and includes the adjusting means running on a reduced power supply to compensate for irregularities in the DC voltage caused by asymmetry in properties between the active matrix substrate and the opposite substrate sandwiching the liquid crystal layer.

Alternatively, the drive circuit for use in a liquid crystal display in accordance with the present invention may include the features of the foregoing drive circuit for use in a liquid crystal display, wherein the voltage level altering means is provided in reference voltage generator means for producing source driver reference voltages from which the source driver produces the source signal voltages and composed of: voltage divider means for dividing the difference between the high and low reference voltages into partial voltages which are transmitted as the source driver reference voltages; high-and-low-reference-voltage-interconnecting means for altering the two reference voltages, i.e., the high reference voltage and the low reference voltage, in an interconnected manner; and low-reference-voltage-specifying means for specifying the ratio of the low reference voltage to the high reference voltage.

According to the foregoing invention, the reference voltage generator means for producing source driver reference voltages from which the source driver produces the source signal voltages, first, the low-reference-voltage-specifying means specifies the ratio of the low reference voltage to the high reference voltage. The ratio of the low reference voltage is determined, for example, so as to compensate for the effects of variations in the drain voltages caused by the presence of parasitic capacity in the thin film transistors.

Subsequently, the high-and-low-reference-voltage-interconnecting means alters the two reference voltages, i.e., the high and low reference voltages, in an interconnected manner; therefore, for example, the potential difference between the high reference voltage and the low reference voltage determined in consideration of the effects of variations in the drain voltages can be preserved.

Next, the voltage divider means divides the potential difference between the high and low reference voltages to supply source driver reference voltages as outputs.

As a result, the source driver receives, for example, the source driver reference voltages determined in consideration of the effects of variations in the drain voltages the source driver can supply to the pixel electrodes the source signal at the voltage levels determined in consideration of the effects of variations in the drain voltages and other factors.

The effects of variations in the drain voltages differ from one liquid crystal display to another; the variations can be compensated for by adapting the low-reference-voltage-specifying means to renew the ratio of the low reference voltage to the high reference voltage. Thus, the voltage levels of the source signals supplied by the source driver can be shifted equally for all the pixel electrodes.

This arrangement gives a concrete construction of the voltage level altering means as the adjusting means. Unquestionably, the drive circuit for use in a liquid crystal display is applicable to portable and other electronics operative without necessarily performing periodical D/A conversions and includes the adjusting means running on a reduced power supply.

Alternatively, the drive circuit for use in a liquid crystal display in accordance with the present invention may include the features of the foregoing drive circuit for use in a liquid crystal display, wherein the voltage level altering means is adapted to be able to supply as outputs a plurality of sets of source drive reference voltages when dividing the difference between the high and low reference voltages into partial voltages.

Under these circumstances, the effects of parasitic capacity of the thin film transistors on the drain voltages change with the voltage applied to liquid crystal. Therefore, the potential differences between the pixel electrodes and the common electrode needs be changed for a white display and a black display.

In this regard, with this invention, the potential differences between the pixel electrodes and the common electrode is readily changed for a white display and a black display, since the voltage divider means is adapted to be capable of, when dividing the voltage difference between the high reference voltage and the low reference voltage, supplying as outputs a plurality of sets of reference voltages for use in a source driver. As a result, the drive circuit for use in a liquid crystal display is highly functional.

Alternatively, the drive circuit for use in a liquid crystal display in accordance with the present invention may include the features of the foregoing drive circuit for use in a liquid crystal display, wherein the high-and-low-reference-voltage-interconnecting means is composed of an adder circuit including an OP-amplifier for adding the two sets of produced voltages with each other to supply the high reference voltage as an output and a subtractor circuit including an OP-amplifier for subtracting the two sets of produced voltages with each other to supply the low reference voltage as an output.

According to the foregoing invention, the high-and-low-reference-voltage-interconnecting means can alter the two reference voltages, i.e., the high and low reference voltages, in an interconnected manner. This is how the high-and-low-reference-voltage-interconnecting means is specifically made.

Alternatively, the drive circuit for use in a liquid crystal display in accordance with the present invention may include the features of the foregoing drive circuit for use in a liquid crystal display, wherein the high-and-low-reference-voltage-interconnecting means is composed of a first inverter-amplifier circuit including an OP-amplifier for supplying as an output the low reference voltage from the two sets of produced voltages and a second inverter-amplifier circuit including an OP-amplifier for supplying as an output the high reference voltage from the two sets of produced voltages.

According to the foregoing invention, the high-and-low-reference-voltage-interconnecting means can alter the two sets of reference voltages, i.e., the high and low reference voltages, in an interconnected manner. This is how the high-and-low-reference-voltage-interconnecting means is specifically made.

Alternatively, the drive circuit for use in a liquid crystal display in accordance with the present invention may include the features of the foregoing drive circuit for use in a liquid crystal display, wherein the high-and-low-reference-voltage-interconnecting means is composed of: a low-reference-voltage-producing D/A conversion circuit for receiving DC level adjustment data and supplying the low reference voltage as an output; a digital adder circuit for adding the high-and-low-reference-voltage-level-difference-specifying data with the DC level adjustment data; and an high-reference-voltage-producing D/A conversion circuit for receiving this addition data supplied by the digital adder circuit and supplying the high reference voltage as an output.

According to the foregoing invention, the high-and-low-reference-voltage-interconnecting means can alter the two reference voltages, i.e., the high and low reference voltages, in an interconnected manner. This is how the high-and-low-reference-voltage-interconnecting means is specifically made.

Alternatively, the drive circuit for use in a liquid crystal display in accordance with the present invention may include the features of the foregoing drive circuit for use in a liquid crystal display and be provided with common electrode signal generator means including switching means only for switching between the ground potential and the positive power source to provide a fixed potential to the common electrode.

With this invention, the switching means in the common electrode signal generator means ensures that the potential of the common electrode is maintained at a fixed value. As a result, a conventionally indispensable clamp circuit with resistors for voltage adjustment is no longer necessary, which eliminates possibilities of increased power consumption due to the presence of a clamp circuit. The elimination of the clamp circuit and capacitor makes it possible to use the drive circuit for low frequency drive and suspension drive.

Therefore, the drive circuit for use in a liquid crystal display is applicable to portable and other electronics operative without necessarily performing periodical D/A conversions and includes the adjusting means running on a undoubtedly reduced power supply.

Alternatively, the drive circuit for use in a liquid crystal display in accordance with the present invention may include the features of the foregoing drive circuit for use in a liquid crystal display, wherein the common electrode signal generator means is built in the source driver.

According to the foregoing invention, the common electrode signal generator means produces a common electrode signal that is never lower than the ground potential and because of its simple arrangement, can be readily built in the source driver. The provision of the common electrode signal generator means in the source driver would enable cost reductions by way of integrated circuitry.

The liquid crystal display in accordance with the present invention includes the foregoing drive circuit for use in a liquid crystal display.

With the present invention, the liquid crystal display is applicable to portable and other electronics operative without necessarily performing periodical D/A conversions and includes the adjusting means running on a reduced power supply to adjust the potential differences between the pixel electrodes and the common electrode.

The electronics in accordance with the present invention include the liquid crystal display.

With the present invention, the electronics can be portable and requires no periodical D/A conversions and that the adjusting means runs on a reduced power supply to adjust the potential differences between the pixel electrodes and the common electrode.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A drive circuit for use in a liquid crystal display, said drive circuit supplying source signal from a source driver to pixel electrodes through switching by means of thin film transistors according to scan signals from a gate driver, said drive circuit comprising adjusting means for adjusting potential differences between the pixel electrodes and a common electrode, wherein the adjusting means is composed of voltage level altering means for shifting voltage levels of the source signals supplied by the source driver equally for all the pixel electrodes, wherein the voltage level altering means provided in a reference voltage generator means for producing source driver reference voltages from which the source driver produces the voltage levels of the source signals and is composed of: voltage divider means for producing and supplying the source driver reference voltages by voltage division of a difference between high and low reference; voltages high-and-low-reference-voltage-interconnecting means for altering the high and low reference voltages in an interconnected manner; and low-reference-voltages-specifying means for specifying a ratio of the low reference voltage to the high reference voltage.

2. The drive circuit as defined in claim 1, wherein the adjusting means adjusts the potential differences between the pixel electrodes and the common electrode to compensate for effects of variations in drain voltages caused by parasitic capacity in the thin film transistors.

3. The drive circuit as defined in claim 1, wherein when the pixel electrodes are made of a plurality of kinds of metal film layers, the adjusting means adjusts the potential differences between the pixel electrodes and the common electrode to compensate for irregularities in DC voltage component between drains of the thin film transistors and one of the plurality of kinds of metal film layers that constitutes the pixel electrodes electrically connected to the drains and that is located closer to a liquid crystal layer than the other metal film(s).

4. The drive circuit as defined in claim 1, wherein the adjusting means adjusts the potential differences between the pixel electrodes and the common electrode to compensate for irregularities in DC voltage caused by asymmetry in properties between an active matrix substrate and an opposite substrate sandwiching a liquid crystal layer.

5. The drive circuit as defined in claim 1, wherein the voltage divider means is capable of producing a plurality of mutually different sets of voltages as the source drive reference voltages and selectively supplying one of the sets as outputs.

6. The drive circuit as defined in claim 1, wherein the high-and-low-reference-voltage-interconnecting means is composed of: an adder circuit including an OP-amplifier for adding two sets of produced voltages with each other to supply the high reference voltage as an output; and a subtractor circuit including an OP-amplifier for subtracting the two sets of produced voltages with each other to the low reference voltage as an output.

7. The drive circuit as defined in claim 1, wherein the high-and-low-reference-voltage-interconnecting means is composed of a first inverter-amplifier circuit including an OP-amplifier for supplying as an output the low reference voltage from two sets of produced voltages and a second inverter-amplifier circuit including an OP-amplifier for supplying as an output the high reference voltage from the two sets of produced voltages.

8. The drive circuit as defined in claim 1, wherein the high-and-low-reference-voltage-interconnecting means is composed of: a low-reference-voltage-producing D/A conversion circuit for receiving DC level adjustment data and supplying the low reference voltage as an output; a digital adder circuit for adding the high-and-low-reference-voltage-level-difference-specifying data with the DC level adjustment data; and an high-reference-voltage-producing D/A conversion circuit for receiving the addition data supplied by the digital adder circuit and supplying the high reference voltage as an output.

9. The drive circuit as defined in claim 1, further comprising common electrode signal generator means including switching means only for switching between the ground potential and the positive power source to provide a fixed potential to the common electrode.

10. The drive circuit as defined in claim 9, wherein the common electrode signal generator means is built in the source driver.

11. A liquid crystal display, comprising a drive circuit for use in a liquid crystal display, said drive circuit supplying source signals from a source driver to pixel electrodes through switching by means of thin film transistors according to scan signals from a gate driver, said drive circuit including adjusting means for adjusting potential differences between the pixel electrodes and a common electrode, wherein the adjusting means is composed of voltage level altering means for shifting voltage levels of the source signals supplied by the source driver equally for all the pixel electrodes, wherein the voltage level altering means is provided in a reference voltage generator means for producing source driver reference voltages from which the source driver produces the voltage level of the source signals and is composed of: voltage divider means for producing and supplying the source driver reference voltages by voltage division of a difference between high and low reference voltages; high-and-low-reference-voltages-interconnecting means for altering the high and low reference voltages in an interconnected manner; and low-reference-voltage-specifying means for specifying a ratio of the low reference voltage to the high reference voltage.

12. The liquid crystal display as defined in claim 11, wherein the voltage divider means is capable of producing a plurality of mutually different sets of voltages as the source drive reference voltages and selectively supplying one of the sets as outputs.

13. The liquid crystal display as defined in claim 11, wherein the high-and-low-reference-voltage-interconnecting means is composed of: an adder circuit including an OP-amplifier for adding two sets of produced voltages with each other to supply the high reference voltage as an output; and a subtractor circuit including an OP-amplifier for subtracting the two sets of produced voltages with each other to supply the low reference voltage as an output.

14. The liquid crystal display as defined in claim 11, wherein the high-and-low-reference-voltage-interconnecting means is composed of a first inverter-amplifier circuit including an OP-amplifier for supplying as an output the low reference voltage from two sets of produced voltages and a second inverter-amplifier circuit including an OP-amplifier for supplying as an output the high reference voltage from the two sets of produced voltages.

15. The liquid crystal display as defined in claim 11, wherein the high-and-low-reference-voltage-interconnecting means is composed of: a low-reference-voltage-producing D/A conversion circuit for receiving DC level adjustment data and supplying the low reference voltage as an output; a digital adder circuit for adding the high-and-low-reference-voltage-level-difference-specifying data with the DC level adjustment data; and an high-reference-voltage-producing D/A conversion circuit for receiving the addition data supplied by the digital adder circuit and supplying the high reference voltage as an output.

16. The liquid crystal display as defined in claim 11, said drive circuit further including common electrode signal generator means including switching means only for switching between the ground potential and the positive power source to provide a fixed potential to the common electrode.

17. The liquid crystal display as defined in claim 16, wherein the common electrode signal generator means is built in the source driver.

18. The liquid crystal display as defined in claim 11, wherein the liquid crystal display is one of reflective, opaque, reflective/transparent, or transparent types.

19. Electronics, comprising a liquid crystal display including a drive circuit for use in a liquid crystal display, said drive circuit supplying source signals from a source driver to pixel electrodes through switching by means of thin film transistors according to scan signals from a gate driver, said drive circuit including adjusting means for adjusting potential differences between the pixel electrodes and a common electrode, wherein the adjusting means is composed of voltage level altering means for shifting levels of the voltage levels of the source signals supplied by the source driver equally for all the pixel electrodes, wherein the voltage level altering means is provided in a reference voltage generator means for producing source driver reference voltages from which the source driver produces voltages levels of the source signals and is composed of: voltage divider means for producing and supplying the source driver reference voltages by voltage division of a difference between high and low reference voltages; high-and-low-reference-voltage-interconnecting means for altering the high and low reference voltages in an interconnected manner; and low-reference-voltage-specifying means for specifying a ratio of the low reference voltage to the high reference voltage.

20. The electronics as defined in claim 19, wherein the voltage divider means is capable of producing a plurality of mutually different sets of voltages as the source drive reference voltages and selectively supplying one of the sets as outputs.

21. The electronics as defined in claim 19, wherein the high-and-low-reference-voltage-interconnecting means is composed of: an adder circuit including an OP-amplifier for adding two sets of produced voltages with each other to supply the high reference voltage as an output; and a subtractor circuit including an OP-amplifier for subtracting the two sets of produced voltages with each other to supply the low reference voltage as an output.

22. The electronics as defined in claim 19, wherein the high-and-low-reference-voltage-interconnecting means is composed of a first inverter-amplifier circuit including an OP-amplifier for producing as an output the low reference voltage from two sets of produced voltages and a second inverter-amplifier circuit including an OP-amplifier for producing as an output the high reference voltage from the two sets of produced voltages.

23. The electronics as defined in claim 19, wherein the high-and-low-reference-voltage-interconnecting means is composed of: a low-reference-voltage-producing D/A conversion circuit for receiving DC level adjustment data and supplying the low reference voltage as an output; a digital adder circuit for adding the high-and-low-reference-voltage-level-difference-specifying data with the DC level adjustment data; and an high-reference-voltage-producing D/A conversion circuit for receiving the addition data supplied by the digital adder circuit and supplying the high reference voltage as an output.

24. The electronics as defined in claim 19, said driver circuit further including common electrode signal generator means including switching means only for switching between the ground potential and the positive power source to provide a fixed potential to the common electrode.

25. The drive circuit for use in a liquid crystal display as defined in claim 24, wherein the common electrode signal generator means is built in the source driver.

26. The electronics as defined in claim 19, wherein the liquid crystal display is one of reflective, opaque, reflective/transparent, or transparent types.

27. The electronics as defined in claim 19, wherein the electronics include a mobile telephone, a personal data assistant, a notebook personal computer, a portable television set, and a portable game machine.

* * * * *